US008341981B2

(12) United States Patent
Kim et al.

(10) Patent No.: US 8,341,981 B2
(45) Date of Patent: Jan. 1, 2013

(54) WASHING MACHINE

(75) Inventors: Bo Yeon Kim, Changwon-si (KR); Hyung Gyu Lim, Changwon-si (KR); In Ho Cho, Changwon-si (KR)

(73) Assignee: LG Electronics Inc., Seoul (KR)

( * ) Notice: Subject to any disclaimer, the term of this patent is extended or adjusted under 35 U.S.C. 154(b) by 829 days.

(21) Appl. No.: 12/292,561

(22) Filed: Nov. 20, 2008

(65) Prior Publication Data

US 2009/0146536 A1 Jun. 11, 2009

(30) Foreign Application Priority Data

Nov. 21, 2007 (KR) ..... 10-2007-0118963
Nov. 21, 2007 (KR) ..... 10-2007-0118964
Nov. 21, 2007 (KR) ..... 10-2007-0118965
Apr. 30, 2008 (KR) ..... 10-2008-0040591

(51) Int. Cl.
*D06F 39/12* (2006.01)

(52) U.S. Cl. ..... 68/3 R; 68/13 R; 312/228

(58) Field of Classification Search ..... 68/3 R, 68/13 R, 19.1, 20; 312/228, 228.1
See application file for complete search history.

(56) References Cited

U.S. PATENT DOCUMENTS

| | | | |
|---|---|---|---|
| 169,760 | A | 11/1875 | Baker |
| 2,048,608 | A | 7/1936 | Holland |
| 2,165,487 | A | 7/1939 | Johnson |
| 2,372,769 | A | 4/1945 | De Remer |
| 2,411,383 | A | 11/1946 | Miller |
| 2,566,488 | A | 9/1951 | Gould |
| 2,579,310 | A | 12/1951 | Dunham |
| 2,750,779 | A | 6/1956 | Whyte |
| 2,816,429 | A | 12/1957 | Kurlancheek |
| 2,866,273 | A | 12/1958 | Geldhof |
| 2,881,609 | A | 4/1959 | Brucken |
| 3,044,667 | A | 7/1962 | Lucas |
| 3,402,477 | A | 9/1968 | Hubbard |
| 3,421,801 | A | 1/1969 | Carpenter et al. |
| 3,539,011 | A | 11/1970 | Hopkins |
| 3,555,701 | A | 1/1971 | Hubbard |
| 4,109,397 | A | 8/1978 | Daily |
| 4,413,867 | A | 11/1983 | Mosebrook et al. |
| 5,078,282 | A | 1/1992 | Stanfield |
| 5,080,204 | A | 1/1992 | Bauer et al. |
| 5,365,959 | A | 11/1994 | Favaro |
| 5,382,087 | A | 1/1995 | Pouch |
| 5,470,142 | A | 11/1995 | Sargeant et al. |

(Continued)

FOREIGN PATENT DOCUMENTS

AR 197471 A1 4/1974

(Continued)

*Primary Examiner* — Joseph L Perrin
(74) *Attorney, Agent, or Firm* — McKenna Long & Aldridge LLP

(57) ABSTRACT

A washing machine is disclosed. A washing machine includes a tub holding wash water, a drum rotatable within the tub to hold laundry, a first cabinet forming a first space provided with the tub and the drum to wash laundry, a second cabinet forming a second space for additional function, the second cabinet formed as one body with the first cabinet, and a single partition wall provided between the first and second cabinets to partition off the second space from the first space, wherein the second cabinet comprises a first frame and a second frame provided in both opposite portions out of front and rear portions and side portions of the second cabinet, the first and second frames having a rectangular shape.

18 Claims, 20 Drawing Sheets

U.S. PATENT DOCUMENTS

| | | | | |
|---|---|---|---|---|
| 5,653,416 | A | 8/1997 | Frank | |
| 6,036,150 | A | 3/2000 | Lehrman | |
| 6,427,966 | B1 | 8/2002 | Blumenschein | |
| 6,618,887 | B2 | 9/2003 | Kim et al. | |
| 6,671,978 | B1 | 1/2004 | McGowan et al. | |
| 6,874,248 | B2 | 4/2005 | Hong et al. | |
| 6,978,556 | B1 | 12/2005 | Cornelious | |
| 7,117,612 | B2 | 10/2006 | Slutsky et al. | |
| 7,513,132 | B2 * | 4/2009 | Wright et al. | 68/18 F |
| 7,628,043 | B2 | 12/2009 | Sunshine et al. | |
| 2002/0042957 | A1 | 4/2002 | Kim et al. | |
| 2002/0056293 | A1 | 5/2002 | Kin et al. | |
| 2004/0226320 | A1 * | 11/2004 | Bongini | 68/3 R |
| 2005/0155393 | A1 * | 7/2005 | Wright et al. | 68/3 R |
| 2005/0172678 | A1 | 8/2005 | Kim et al. | |
| 2005/0178165 | A1 | 8/2005 | Carey et al. | |
| 2005/0275325 | A1 | 12/2005 | Yang | |
| 2006/0156765 | A1 | 7/2006 | Sunshine et al. | |
| 2007/0119072 | A1 | 5/2007 | Kim | |
| 2007/0151120 | A1 | 7/2007 | Tomasi et al. | |
| 2007/0151300 | A1 | 7/2007 | Sunshine | |
| 2007/0249212 | A1 | 10/2007 | Buecker et al. | |
| 2008/0011342 | A1 | 1/2008 | Ryu et al. | |

FOREIGN PATENT DOCUMENTS

| | | | |
|---|---|---|---|
| AR | 198520 | A1 | 6/1974 |
| AR | 056529 | A1 | 10/2007 |
| CN | 1349012 | A | 5/2002 |
| CN | 1542208 | | 11/2004 |
| CN | 1715518 | | 1/2006 |
| CN | 1880554 | A | 12/2006 |
| DE | 94 19 048 | | 3/1995 |
| DE | 203 02 572 | | 4/2003 |
| DE | 20 2004 010 585 | U1 | 9/2004 |
| DE | 10 2005 036 062 | A1 | 2/2007 |
| DE | 10 2006 055 379 | | 6/2007 |
| DE | 10 2008 027 977 | | 1/2009 |
| EP | 0 238 115 | | 9/1987 |
| EP | 0747523 | | 12/1996 |
| EP | 0 882 768 | A2 | 12/1998 |
| EP | 0943721 | | 9/1999 |
| EP | 0 950 749 | | 10/1999 |
| EP | 1 369 523 | | 12/2003 |
| EP | 1 550 756 | A1 | 7/2005 |
| EP | 1 621 660 | A2 | 2/2006 |
| EP | 1 726 703 | | 11/2006 |
| FR | 1 182 103 | | 6/1959 |
| GB | 566372 | | 12/1944 |
| GB | 817788 | | 8/1959 |
| GB | 846 251 | | 8/1960 |
| GB | 1 510 528 | | 5/1978 |
| JP | 53-0047164 | A | 4/1978 |
| JP | 54-108060 | | 8/1979 |
| JP | 2-261499 | A | 10/1990 |
| JP | 9-215888 | | 8/1997 |
| JP | 10015276 | | 1/1998 |
| JP | 11-309292 | A | 11/1999 |
| JP | 2005-270593 | | 10/2005 |
| KR | 10-2004-0009400 | A | 1/2004 |
| KR | 10-0701329 | B1 | 3/2007 |
| RU | 2 291 922 | | 1/2007 |
| RU | 2317357 | | 2/2008 |
| WO | WO 02/12609 | A1 | 2/2002 |
| WO | WO 2004/069019 | A2 | 8/2004 |
| WO | WO 2008/069607 | A2 | 6/2008 |
| WO | WO 2008/084932 | A2 | 7/2008 |

* cited by examiner

WASHING MACHINE

CROSS REFERENCE TO RELATED APPLICATION

This application claims the benefit of the Korean Patent Application Nos. 10-2007-0118963 filed on Nov. 21, 2007, 10-2007-0118964 filed on Nov. 21, 2007, 10-2007-0118965 filed on Nov. 21, 2007 and 10-2008-0040591 filed on Apr. 30, 2008 which are hereby incorporated by reference as if fully set forth herein.

BACKGROUND OF THE DISCLOSURE

1. Field of the Disclosure

The present invention relates to a washing machine. More particularly, the present invention relates to a cabinet of a washing machine.

2. Discussion of the Related Art

Typically, washing machines are electric appliances which wash washing objects such as clothes, cloth items and beddings (hereinafter, laundry) by using mechanical friction between laundry and detergent. Such the washing machine may be useable combinedly together with auxiliary devices having a predetermined size.

The auxiliary device may be provided under or on the washing machine and it can provide a user with various kinds of additional functions. However, these auxiliary devices are designed and produced as independent devices from the washing machine. As a result, if these independent auxiliary devices are installed at the washing machine, lots of works may be required. In addition, it is common that an exterior appearance of the washing machine having auxiliary device installed together may not be satisfactory.

SUMMARY OF THE DISCLOSURE

Accordingly, the present invention is directed to a device for treating laundry which is capable of securing a water drain height, with improved inner space utilization.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

The present invention is invented to provide a washing machine having a high productivity and enhanced exterior appearance.

To achieve these objects and other advantages and in accordance with the purpose of the invention, as embodied and broadly described herein, a washing machine includes a tub holding wash water, a drum rotatable within the tub to hold laundry, a first cabinet forming a first space provided with the tub and the drum to wash laundry, a second cabinet forming a second space for additional function, the second cabinet formed as one body with the first cabinet, a single partition wall provided between the first and second cabinets to partition off the second space from the first space, wherein the second cabinet comprises a first frame and a second frame provided in both opposite portions out of front and rear portions and side portions of the second cabinet, the first and second frames having a rectangular shape.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
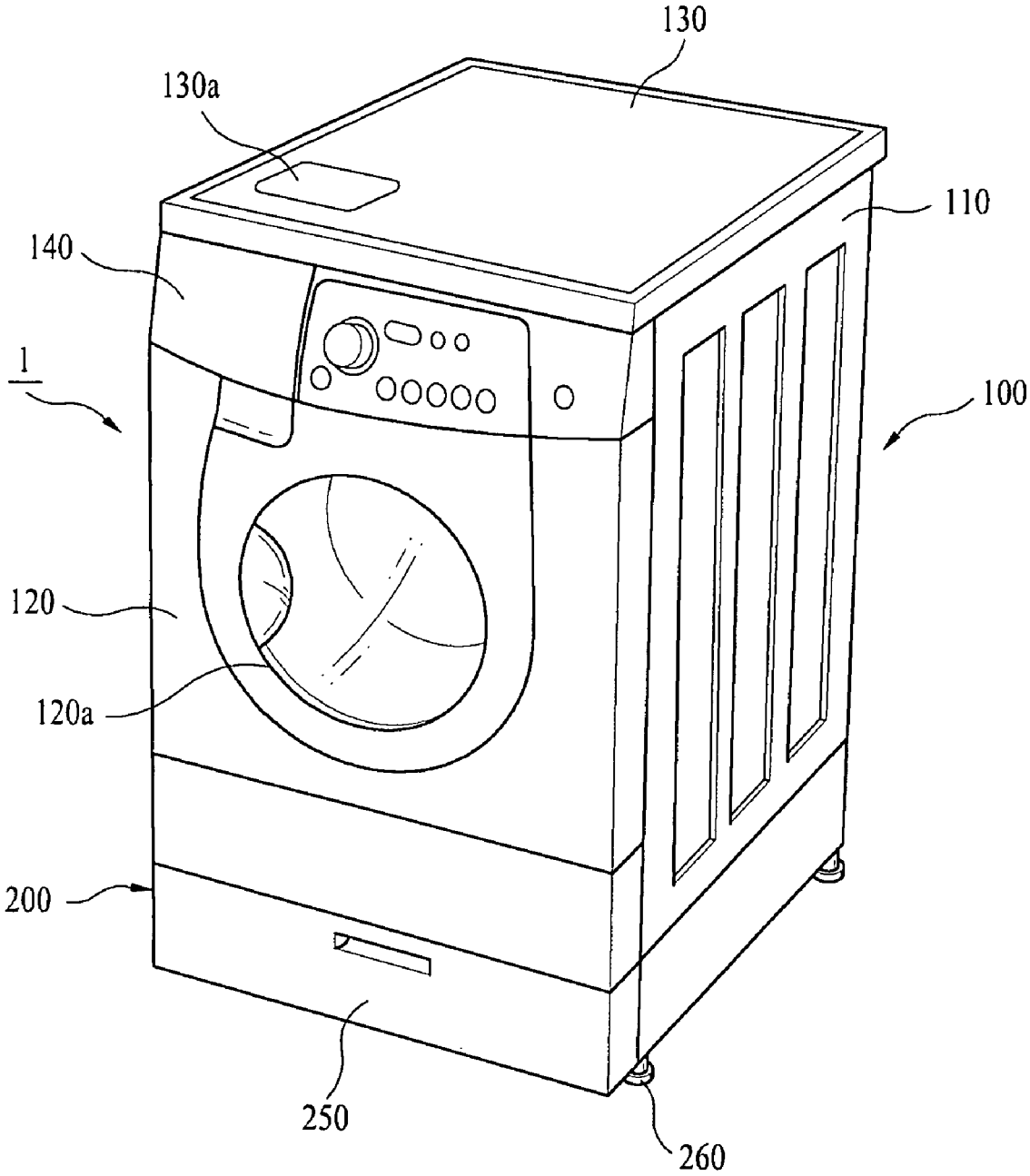
FIG. 1 is a perspective view illustrating a washing machine according to an exemplary embodiment.
Figure 2A:
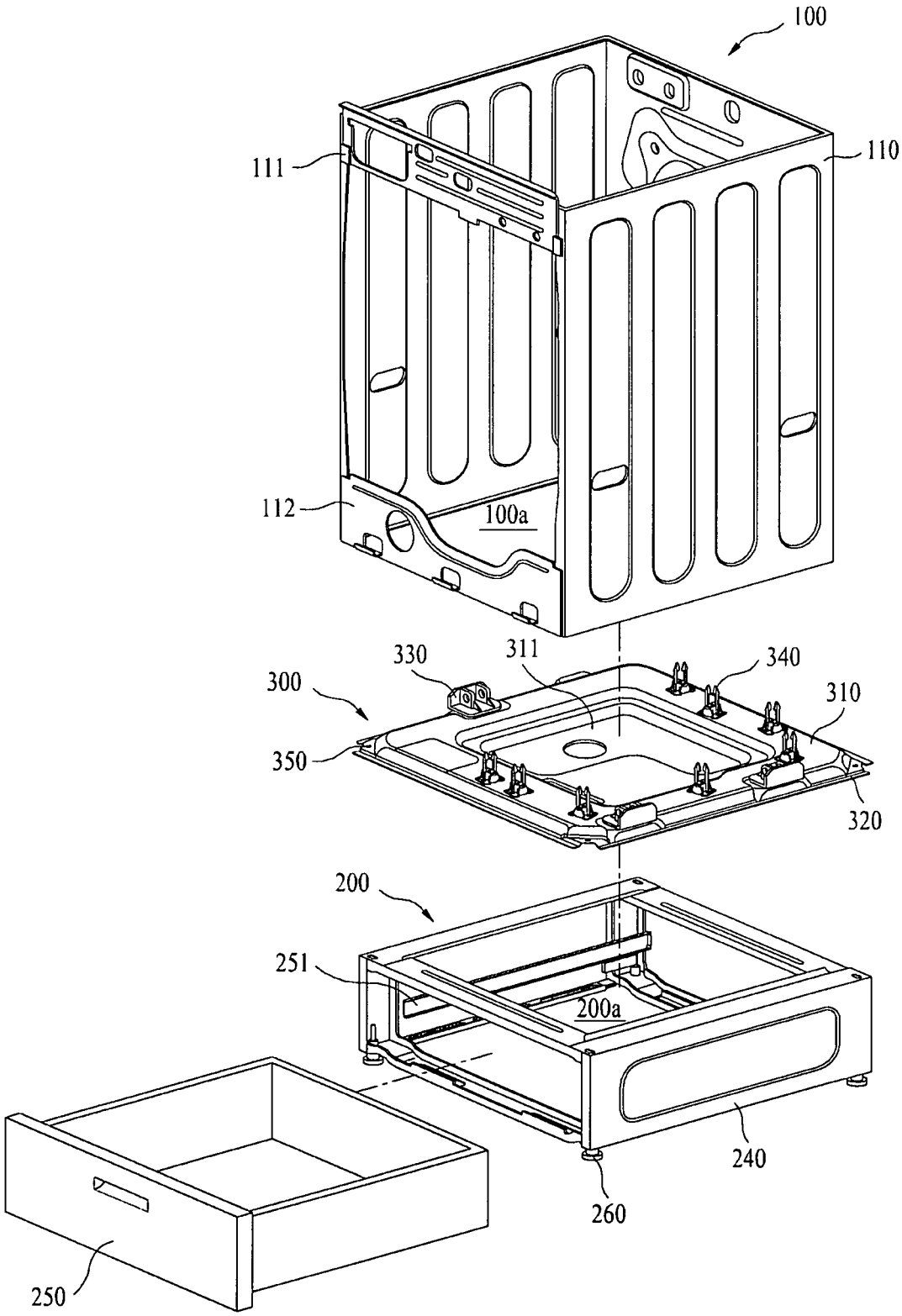
FIG. 2*a* is an exploded perspective view illustrating a cabinet provided in the washing machine of FIG. 1.
Figure 2B:
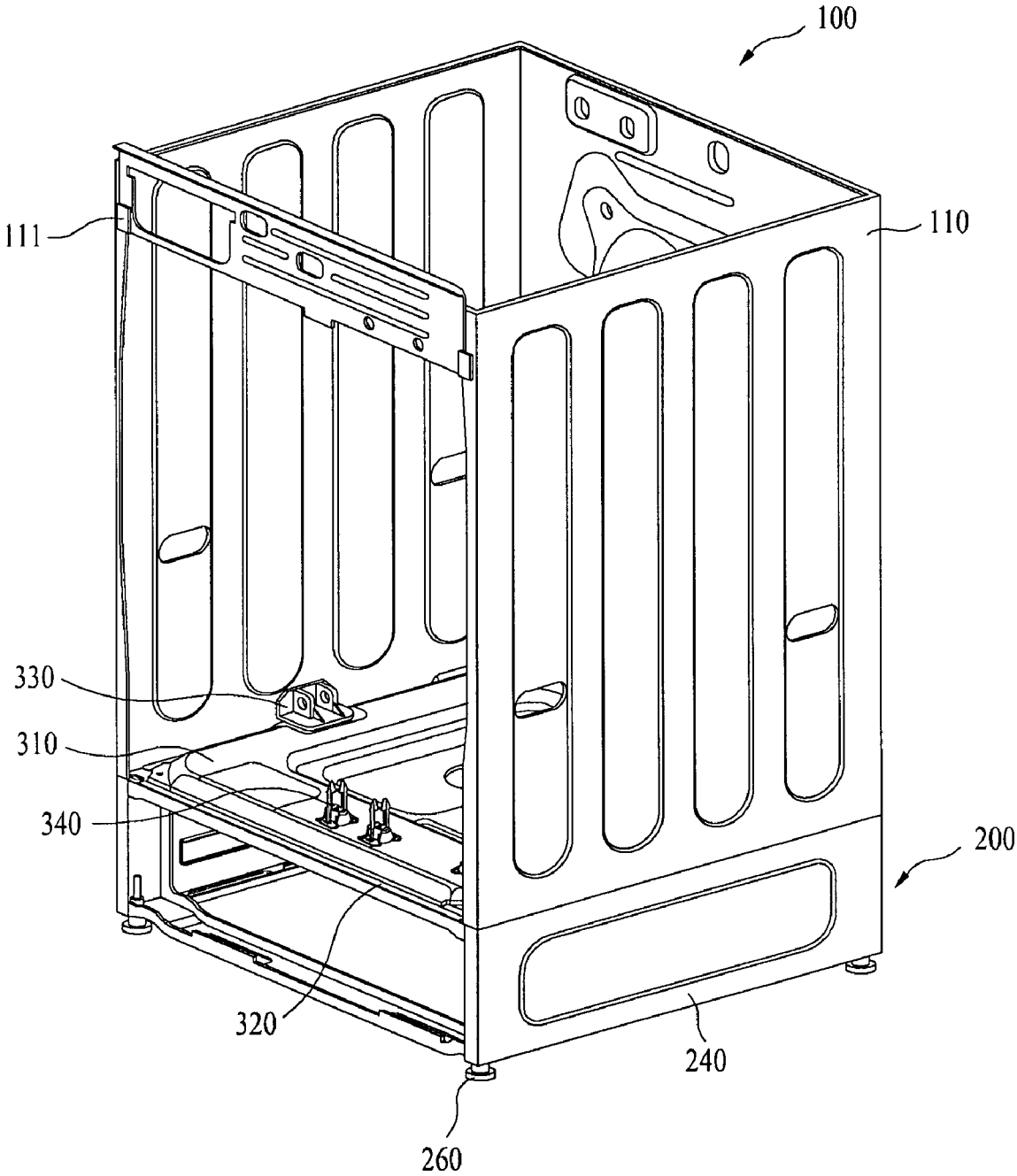
FIG. 2*b* is a perspective view illustrating the cabinet.

FIG. 1 is a perspective view illustrating a washing machine according to an exemplary embodiment. FIG. 2*a* is an exploded perspective view illustrating a cabinet of the washing machine. FIG. 2*b* is a perspective view illustrating a state that components of the cabinet shown in FIG. 2*a* are coupled to each other.

In reference to FIGS. 1 to 2*b*, a washing machine 1 according to an exemplary embodiment includes a first cabinet 100 defining a main body.

The first cabinet 100 is configured of a body 110 including side panels and a rear panel. The body 110 forms a first space 100*a* and mechanical devices for washing laundry are accommodated in the first space 100*a*. For example, a tub is installed in the first space 100*a* to hold wash water and a drum is rotatably installed in the tub to hold the laundry and to perform washing. In addition, power devices are installed at a rear portion or a lower portion of the tub to rotate the drum.

As shown in FIG. 1, a front panel 120 is coupled to a front of the body 110 and a door 120*a* is coupled to the front panel 120. As shown in FIG. 2, a panel frame 111 is installed at an upper front portion of the body 110 and a control panel 140 shown in FIG. 1 is mounted on the panel frame 111. As shown in 2*a*, a lower frame 112 is provided under a lower front portion of the body 110 and peripheral devices including a pump are installed at the lower frame 112. As shown in FIG. 1, a top panel 130 is installed at an upper portion of the body 110 and a cover 130*a* of a detergent box 130*a* is installed at the top panel 130.

The washing machine 1 according to the exemplary embodiment includes a second cabinet 200 provided adjacent to the first cabinet 100. A second space 200*a* is formed in the second cabinet 200 and devices for additional functions may be accommodated in the second space 200*a*. As shown in FIG. 2*a*, the second cabinet 200 may accommodate a drawer 250 forming a predetermined storage space for the additional functions. To retract the drawer 250 smoothly, as shown in FIG. 2*a*, guide rails 251 may be installed at both opposite side panels of the second cabinet 200, respectively.

For example, the second space 200*a* may accommodate accessories, that is, tools for repairing the washing machine, for example, a manual, detergent and bleach. Whenever necessary, the user can take out the accessories from the second space 200*a*. If the drawer 250 is installed in the second space 200*a*, the accessories are accommodated in the drawer 250 and then the user can store the accessories conveniently.

On the other hand, the second space 200*a* may be configured to accommodate auxiliary washing machines. Such the auxiliary washing machines may wash relatively small sized laundry, for example, handkerchiefs, socks and infants' or children's clothes.

Specifically, the auxiliary washing machine may include an auxiliary tub for holding wash water and an auxiliary drum for holding laundry. Here, the auxiliary washing machine may further include other elements which enable small sized laundry to be washed. Such the auxiliary washing machine may perform all of the processes required to wash and dry the small sized laundry, specifically, a washing, rinsing, spinning and drying cycle.

If the auxiliary tub and drum lay down sideways and their introduction openings are toward the front of the washing machine, a door may be installed at the front of the second cabinet 200 to introduce the laundry to the auxiliary drum inside. If the auxiliary tub and drum stands vertically, such the auxiliary tub and drum may be accommodated in the drawer 250. If the user pulls the drawer 250 forward, an opening of the auxiliary drum standing vertically is exposed and the laundry may be loaded in the auxiliary drum via the exposed opening. Hence, the user pushes the drawer 250 backward into the second cabinet 200 and selected cycles for the small sized laundry may be performed.

The above auxiliary washing machine may perform washing for the relatively small sized laundry simultaneously while the main washing machine within the first cabinet 100 is performing washing for the relatively large laundry. As a result, because of the auxiliary washing machine, the washing capacity of the washing machine is substantially increased and also washing efficiency is improved.

On the other hand, the second space 200*a* may accommodate washed shoes and clothes. Hot air may be supplied to the second space 200*a* by an auxiliary mounted device. As mentioned above, the shoes and the washed clothes may be accommodated in the drawer 250 conveniently. Accordingly, the shoes and clothes are dried and refreshed by the supplied hot air.

The second cabinet 200 may be provided in any portions of the first cabinet 100 including a top or a bottom panel of the first cabinet 100. However, if the second cabinet 200 is provided under the bottom panel of the first cabinet 100 as mentioned above, the second cabinet 200 may be employed as a supporter of the first cabinet 100 to lift the first cabinet 100 to a predetermined height. If then, a leg 260 may be installed at the bottom panel of the second cabinet to support the washing machine.

The second cabinet 200 accommodates the additional device to substantially supply the user the additional functions as mentioned above. If the second cabinet 200 is designed as an independent device, the independent second cabinet 200 is fabricated and after that the first cabinet 100 should be installed again, which requires more works.

As a result, the second cabinet 200 may be formed as one body with the first cabinet 100. The united first and second cabinets 100 and 200 make it possible for the washing machine to save the material and works required by this washing machine as well as to supply the user the additional functions.

If the first and second cabinets 100 and 200 are fabricated as some parts of independent devices, the first and second cabinets 100 and 200 have legs installed at the lower surface of the first and second cabinets 100 and 200. For example, if the first cabinet 100 is put on the second cabinet, the legs of the first cabinet 100 do not have to be provided. This is because the legs of the first cabinet 100 can be a reason of increasing the overall height of the first and second cabinets 100 and 200. As mentioned above, if the first and second cabinets 100 and 200 are formed as one body, the structure of the first and second cabinets 100 and 200 can be compact because the unnecessary legs may not increase the overall height of the first and second cabinets 100 and 200.

By the way, the first and second spaces 100*a* and 200*a* may accommodate devices having separate functions, respectively. Thus, the above spaces may be separate from each other to avoid the interference among the devices.

Because of the united body of the first and second cabinets 100 and 200, the bottom panel of the first cabinet 100 is in close contact with the top panel of the second cabinet 200. If two separate members are provided at the top panel of the second cabinet and the bottom panel of the first cabinet 100, respectively, the first space 100*a* is separated from the second space 200*a* more definitely and the structural rigid and strength of the washing machine may be achieved. However, this structure may cause a disadvantage of increased weight and works of the washing machine, which is bigger than the expected advantage, and thus it is not preferable. Because of that, a single partition 300 may be provided between the first and second cabinets 100 and 200.

The single partition 300 partitions off the second space 200*a* from the first space 100*a* such that the first and second spaces 100*a* and 200*a* may perform their functions without interference.

In addition, there is no additional partition between the first and second cabinets 100 and 200 and thus the partition 300 covers the bottom of the first cabinet 100, simultaneously covering the top panel of the second cabinet 200. As a result, the partition 300 directly faces the first and second spaces 100*a* and 200*a*.

That is, the partition 300 forms both a predetermined portion of the first cabinet 100 and a predetermined portion of the second cabinet 200 simultaneously. Such the partition 300 can give the washing machine a preferable structural rigid and strength and it prevents the increase of the unnecessary material and works which might happen during the separation of the spaces 100*a* and 200*a*. Moreover, the common element of the partition 300 in both of the first and second cabinets 100 and 200 makes accomplished the substantial united structure between the first and second cabinets 100 and 200.

In addition, the partition 300 may be employed as an element for the accessories required in the washing machines to be mounted, rather than the separation of the first and second spaces 100*a* and 200*a* and the security of the structural strength. Specifically, the partition 300 includes a platform 310 projected to a predetermined height as shown in FIG. 2*a* and an edge portion 320 of a flange type. Because of the platform 310, the partition 300 may have plural bent portions for increasing its section modulus, which results in improved structural strength.

In reference to FIG. 2*a*, on the platform 310 may be installed a plurality of brackets 330, holders 340 and other members additionally.

First, the brackets 330 enable the tub to be mounted on the partition 300, specifically, the brackets 330 are coupled to a damper dampening vibration of the tub.

The holders 340 fix various accessories, for example, wires and terminals of the washing machine may be fixed to the holders 330.

Figure 3:
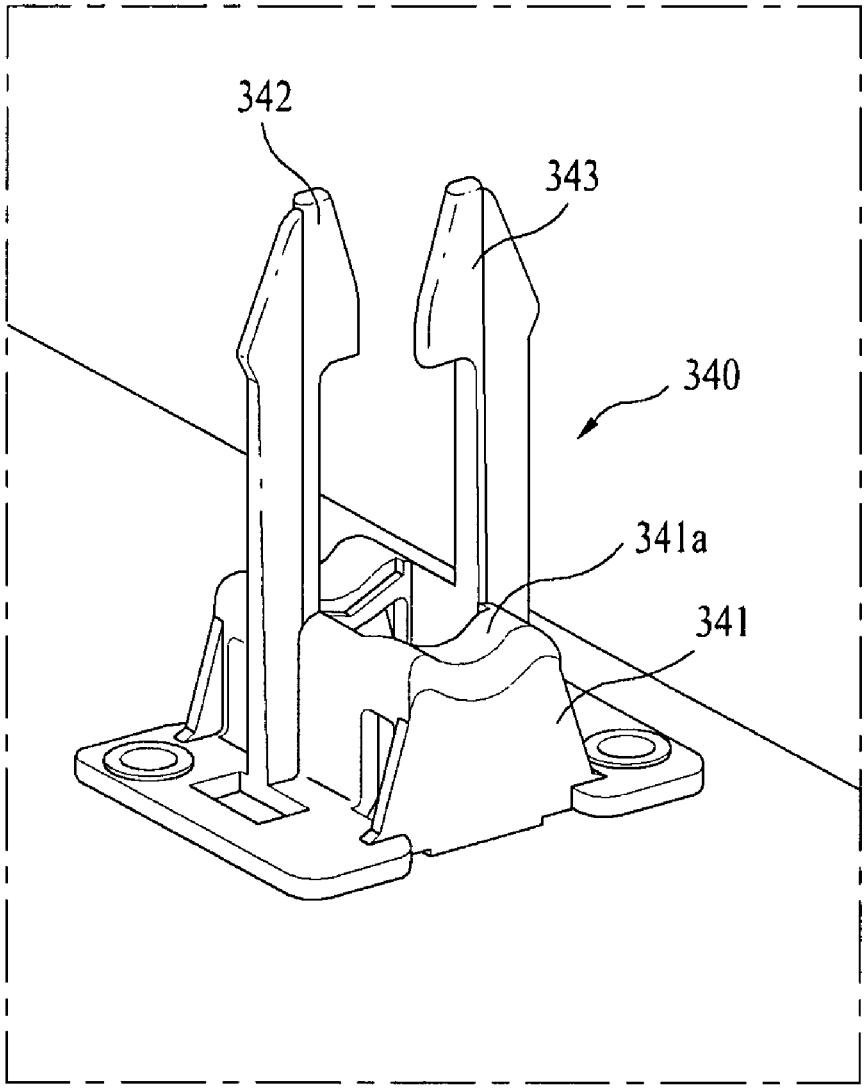
FIG. 3 is a perspective view illustrating a holder coupled to a partition of the cabinet.

As shown in FIG. 3, the holder 340 includes a base 341 secured to the partition 300 and a pair of arms extended upward from the base 341. The pair of the arms may include a first arm 342 and a second arm 343.

The accessories such as the wires may be arranged between the first and second arms 342 and 343 to be seated on a seating portion 341*a* formed on the base 341. The first and second arms 342 and 343 have hooks formed at upper ends of the arms 342 and 343, respectively, and these hooks prevent the separation of the accessories seated between the first and second arms 342 and 343.

The wires may be wound around the first and second arms 342 and 343 and the accessory having a predetermined volume such as a terminal may be hooked at the first and second arms 342 and 343, specifically, the hooks of the first and second arms.

As shown in FIG. 2*a*, the partition 300 may further include a recess 311 formed at a center of the platform 310. Water leaked from the tub or the drum may be primarily stored in the recess 311 not to flow outside the washing machine. In addition, a device capable of sensing the leaked water may be installed in the recess 311.

The partition 300 may have a structure where the leg supporting the first cabinet can be coupled. Specifically, as shown in FIG. 2*a*, a coupling hole 350 may be formed at each corner of the partition 300 and the legs are coupled to the coupling holes 350. Because of this leg coupling structure, the partition 300 may be applicable to the conventional washing machine having only the first cabinet 100 without the second cabinet 200, which can bring common usage of parts capable of improving productivity.

While the above embodiments present the first and second cabinets 100 and 200 having separate side and/or rear panels, the first and second cabinets 100 and 200 may have side and/or rear panels which are unitedly formed as one body. That is, the cabinets 100 and 200 may have only a single side and/or rear panel. As result, similar to the single partition 300, the single side and/or rear panel is shared by the first and second cabinets 100 and 200 such that the first and second cabinets may be substantially united as one body and that the assembly line and material/parts may be reduced.

Figure 4A:
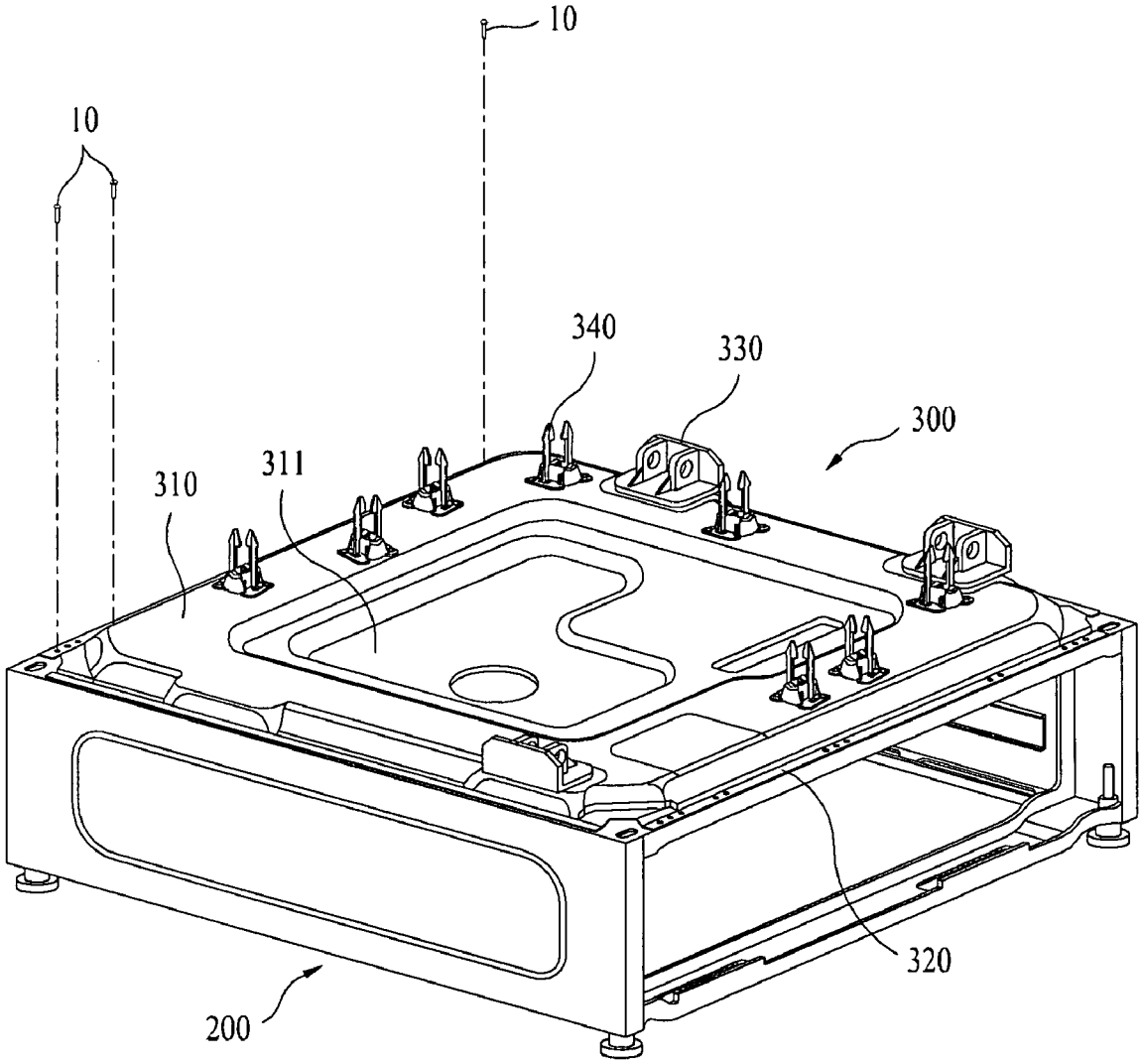
FIGS. 4*a* to 4*c* are perspective views illustrating an assembly process of the cabinet, respectively.
Figure 4B:
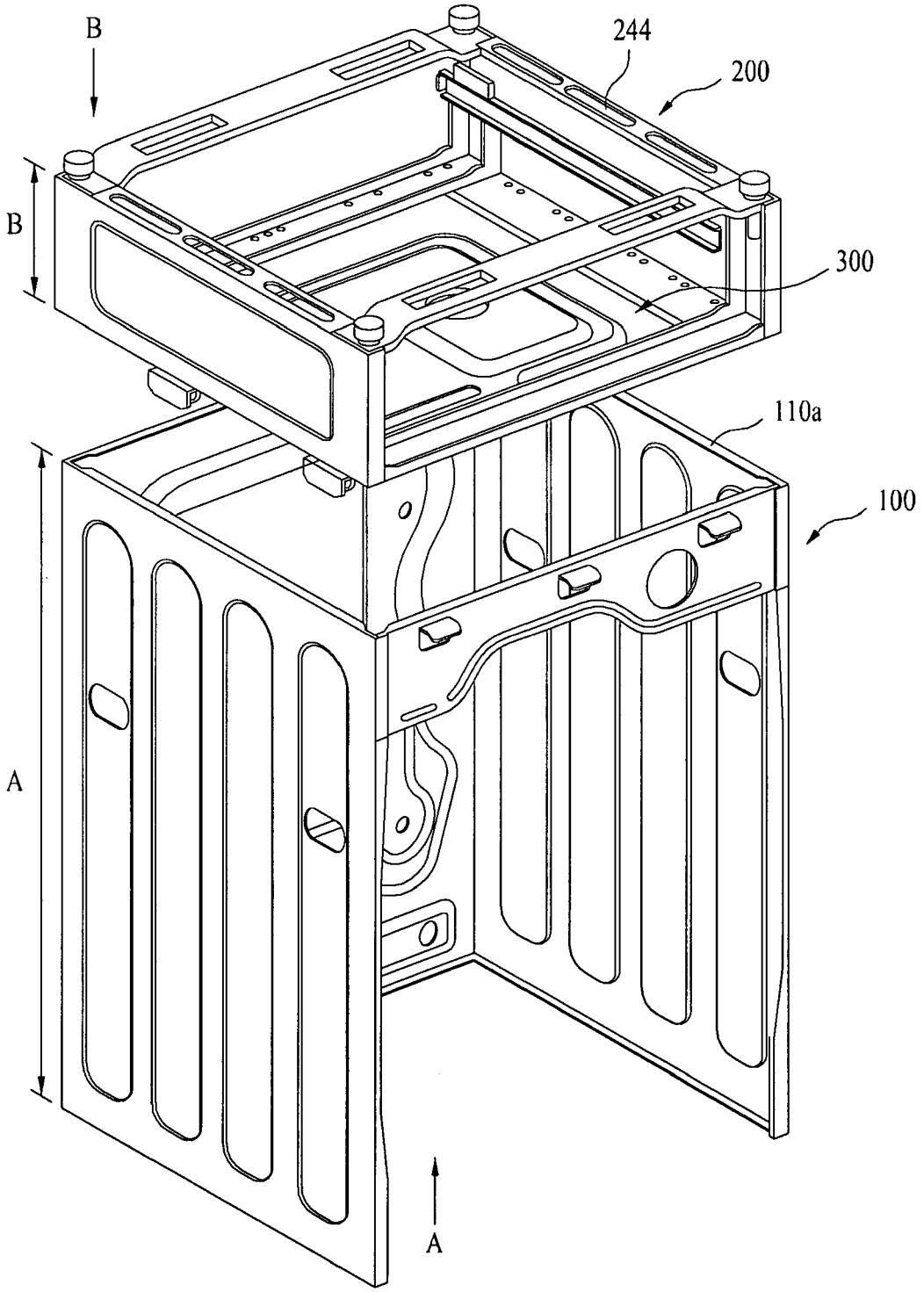

FIGS. 4*a* and 4*b* are perspective views illustrating each assembly process of the first and second cabinets, respectively, showing assemblies seen from different angles for each assembly process. In reference to FIGS. 4*a* and 4*b*, the assembly process of the cabinets provided in the washing machine according to the present invention will be described.

As shown in FIG. 4*a*, the partition 300 is coupled to the top panel of the second cabinet 200. Specifically, the partition 300 is put on the top panel of the second cabinet 200 and the edge portions 320 of the partition 300 are secured to edges of the top panel of the second cabinet 200 by securing members.

At a structural point of view, the partition 300 may be coupled to the bottom of the first cabinet 100 before coupled to the top panel of the second cabinet 200. However, the first cabinet 100 has a substantially much bigger volume than the second cabinet 200. If the partition 300 forms a primary assembly together with the first cabinet 100, it is inconvenient for a worker to work the primary assembly because of the increased weight and volume. Accordingly, as mentioned above, it is advantageous for worker convenience sake to form a primary assembly of the partition 300 and the second cabinet 200.

Next, as shown in FIG. 4*b*, the first cabinet 100 and the primary assembly 200 and 300 are turned upside down.

Specifically, after the first cabinet 100 is turned upside down first, the reversed primary assembly 200 and 300 may be put on the bottom of the first cabinet 100.

According to the conventional assembly, the first cabinet 100 and the primary assembly 200 and 300 are not turned upside down and the first cabinet 100 is put on the top panel of the primary assembly 200 and 300. If then, the securing member secures the first cabinet 100 to the primary assemblies 200 and 300 along a direction of (A) as shown in an arrow.

However, it is inconvenient for the worker to fasten the securing member by using tools because the first cabinet 100 has a side panel with a predetermined height (A). While, the primary assembly 200 and 300 has a substantially less height (B) than the height (A). As a result, it is easy for the worker to use the tools. Reversing both of the first cabinet 100 and primary assembly 200 and 300 may make it convenient for the worker to fasten the first cabinet 100 to the primary assemblies 200 and 300.

Figure 4C:
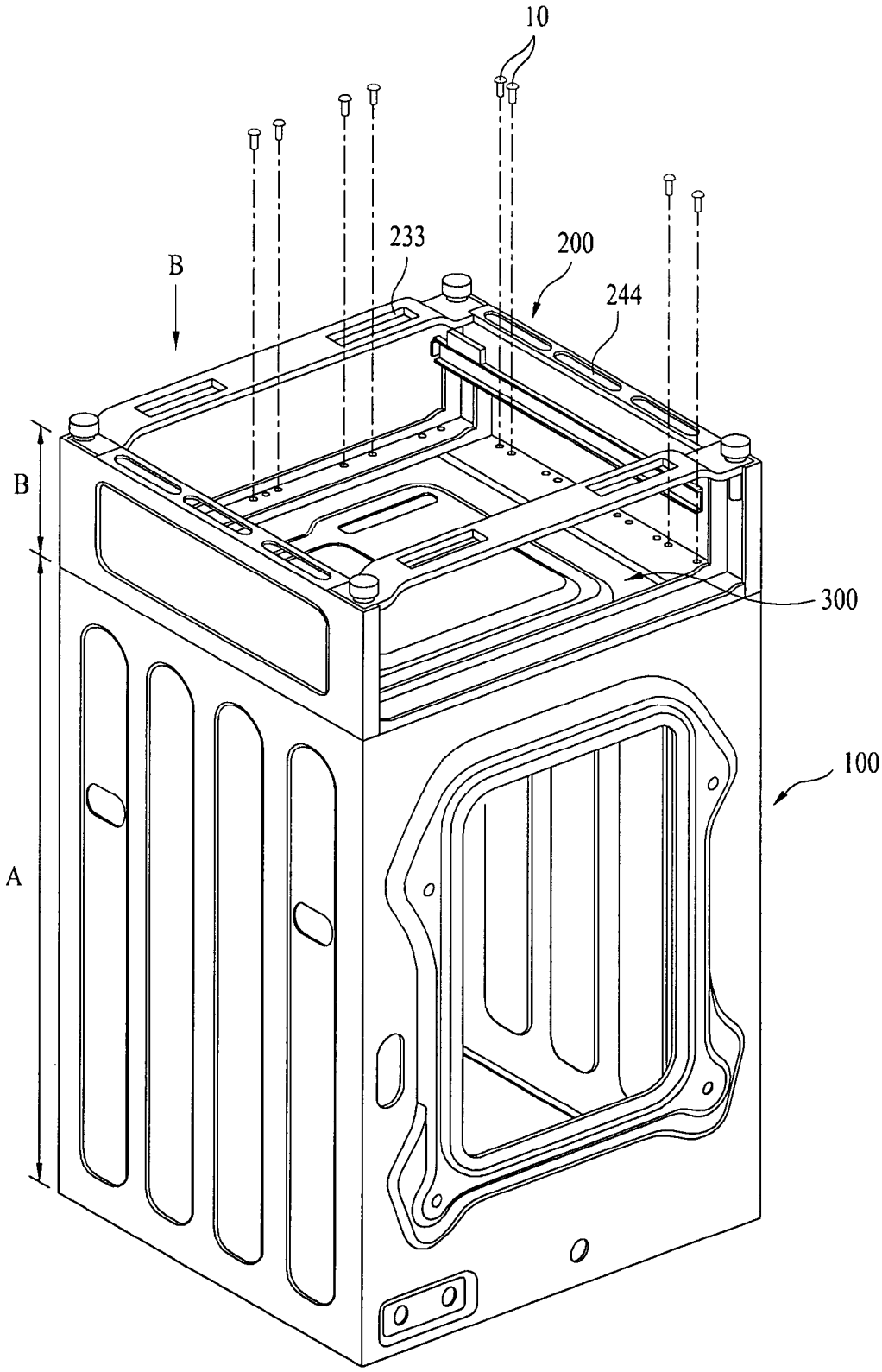

Once the disposing of the first cabinet 100 and the primary assemblies 200 and 300 is complete, the first cabinet 100 and the primary assembly 200 and 300 is fastened to each other by using the securing member 100 as shown in FIG. 4*c*.

As shown in FIG. 4*b*, the primary assembly 200 and 300 is substantially secured to a flange 100*a* formed at an edge portion of the bottom of the first cabinet 100. Specifically, as mentioned above, the securing member 10 secures the first cabinet 100 to the primary assembly 200 and 300 along a predetermined direction (B). That is, the securing member 10 passes through the second cabinet 200, the partition 300 and the first cabinet 100 in order. After that, the secured first cabinet and the assembly 200 and 300 may be turned upside down and the other devices are installed at the complete cabinet structure.

As mentioned above, the assembling method shown in FIGS. 4*a* to 4*c* enables the user to assemble the cabinet smoothly and conveniently, which can bring the substantially improved productivity.

Figure 5A:
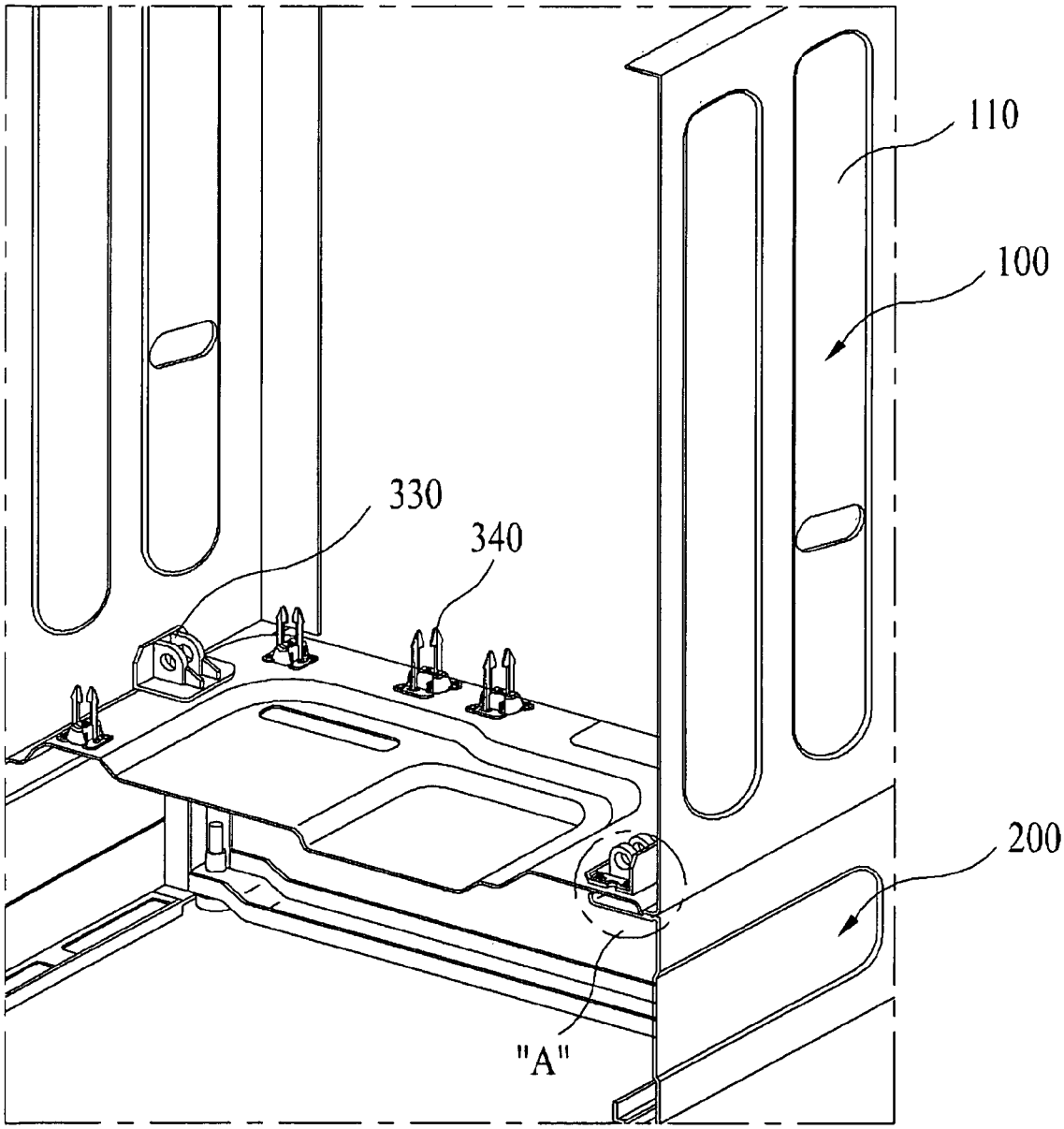
FIG. 5*a* is a perspective view partially illustrating I-I line of 2*b;*
Figure 5B:
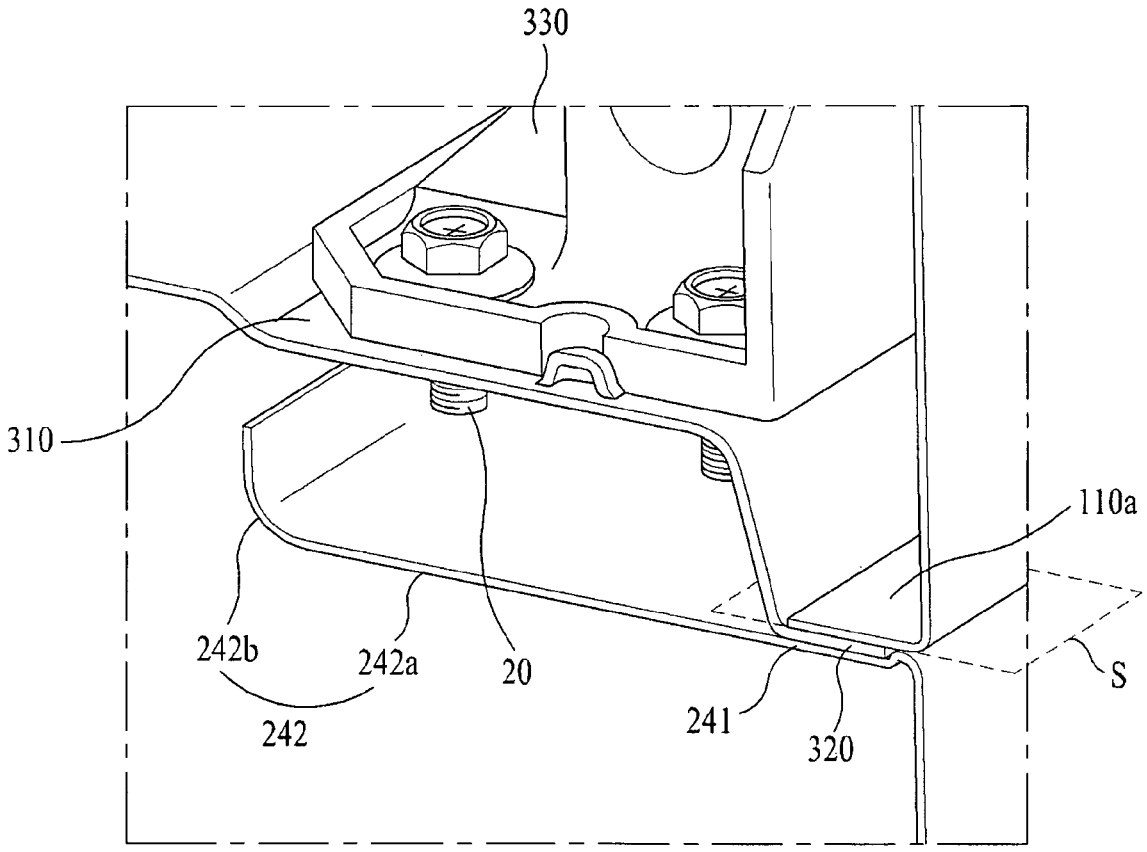
FIG. 5*b* is a partially enlarged view of FIG. 5*a;*

According to the first and second cabinets 100 and 200 which are formed as one body, if a gap exists between side panels of the first and second cabinets, foreign substances might be stuck in the gap or might come into the washing machine via the gap. Such the gap may deteriorate the quality of the exterior appearance of the washing machine. In addition, the gap could make the first and second cabinets 100 and 200 look separate from each other. Accordingly, the first and second cabinets 100 and 200 may be designed to remove the gap and this structure is shown in FIGS. 5*a* and 5*b*. FIG. 5*a* is a perspective view partially illustrating I-I line of FIG. 2*b* and FIG. 5*b* is an enlarged view partially illustrating "A" dotted line shown in FIG. 5*a*.

As mentioned above, since the partition 300 is provided between the first and second cabinets 100 and 200, a gap should be inevitably generated between the side panels of the first and second cabinet 100 and 200, as big as the thickness of the partition 300.

To prevent the gap between the side panels, it is preferable that the washing machine includes a structure capable of accommodating the partition, at least the thickness of the edge portion of the partition 300 which is a coupling portion. Here, the structure is provided at either of the first and second cabinets 100 and 200.

Although both of the first and second cabinets 100 and 200 may include the structures capable of accommodating the thickness of the partition 300 partially, this configuration happens to increase production assembly lines and thus it is not preferable. As shown in FIGS. 4*a* to 4*c*, the second cabinet 200 is coupled to the partition 300 firstly to form the primary assembly, before being coupled with the first cabinet 100. As a result, it is advantageous from an assembly process perspective that the structure capable of accommodating the thickness of the partition 300 is formed at the second cabinet 200.

Specifically, as shown in FIG. 5*b*, the above structure capable of accommodating the thickness of the partition 300 is embodied as a flange 241 extended inward from the side panel of the second cabinet 200.

The flange 241 supports the partition 300, more specifically, the edge portion 320. Also, the flange 241 is recessed downward from an upper end of the side panel of the second cabinet 200 to a predetermined height as much as or more than the thickness of the partition 300. An upper surface of the partition 300, specifically, the edge portion 320 is not projected from the upper end of the side panel of the second cabinet 200, because the upper surface of the partition is mounted on the flange 241.

That is, the upper surface of the partition 300 can be positioned under or on a common plane with the upper end of the side panel of the second cabinet 200.

In the meanwhile, the first cabinet 100 includes a flange 110*a* extended from a lower end of the side panel of the first cabinet 100 and the flange 110*a* is coupled to the partition 300 and the second cabinet 200. Here, it is preferable that the upper surface of the partition 300, specifically, the upper surface of the edge portion 320 is positioned at a common plane with the upper end of the side panel of the second cabinet 200.

Moreover, if the flange 110*a* is mounted on the partition 300, the upper surface of the partition 300 and the facing end surfaces of the side panels of the first and second panels 100 and 200 may be positioned at a common plane (S), which is shown in FIG. 5*b* as a dotted line. At the common plane (S) may be positioned the upper surface of the edge portion 320 of the partition 300, the lower end surface of the side panel of the first cabinet 100 and the upper end surface of the side panel of the second cabinet 200.

As a result, the facing end surfaces of the side panels of the first and second cabinets 100 and 200 are in contact with each other substantially not to generate any gaps. That is, only the single border line included in the common place (S) is formed between the side panels of the cabinets 100 and 200. Because of the removal of the gap, foreign substances cannot be stuck between the first and second cabinets 100 and 200 or cannot come into the washing machine. In addition, the single border line can improve an exterior appearance of the washing machine and it can make the user substantially have a single cabinet.

As shown in FIG. 5*b*, in addition to the flange 241, the side panel of the second cabinet 200 may include a cover 242 to cover ends of the securing members 20. The securing members 20 are useable to secure the accessories including the bracket 220 and the holder 340 to the partition 300.

Specifically, the cover 242 includes a first cover 242*a* and a second cover 242*b*. The first cover 242*a* is extended horizontally to cover a lower end of the securing member 20. Such the first cover 242*a* may be directly extended from the side panel of the second cabinet 200 and it is preferable that the first cover 241*a* is continuously extended from the flange 241 to economize in its production assembly lines and law material.

The second cover 242*b* is extended upward from the first cover 241*a* and it covers a side end of the securing member 20. Because of the cover 242, the injury of the worker or user, which happens by the exposed end of the securing member 20, can be prevented.

In addition, because of the united first and second cabinets 100 and 200 formed as one body, the second cabinet 200 requires a relatively small number of structural components to satisfy the basic structural rigid and strength, compared with the conventional second cabinet as an independent device.

For example, because of the lower structure of the partition 300 and the first cabinet 100, the second cabinet 200 does not require an additional component to secure its upper structure.

Figure 6A:
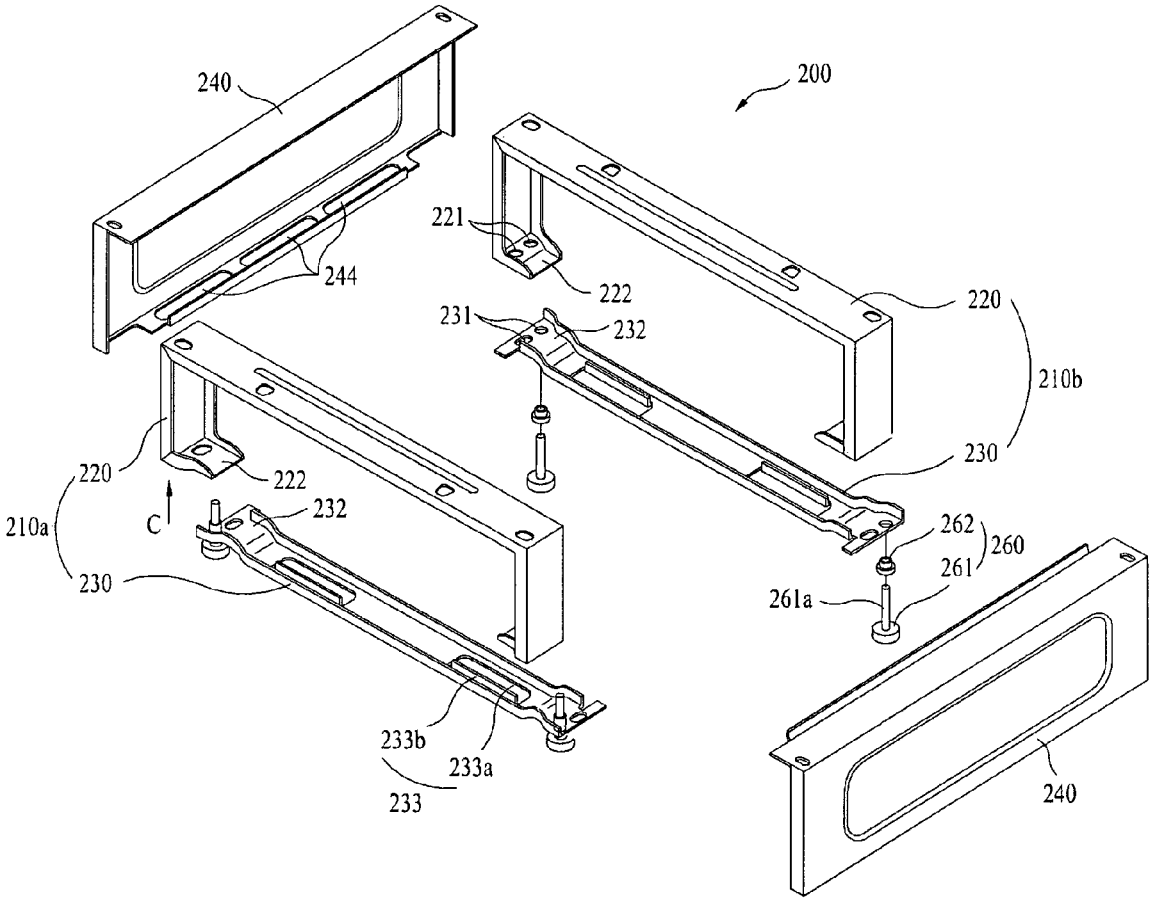
FIG. 6*a* is an exploded view illustrating the second cabinet of the washing machine.
Figure 6B:
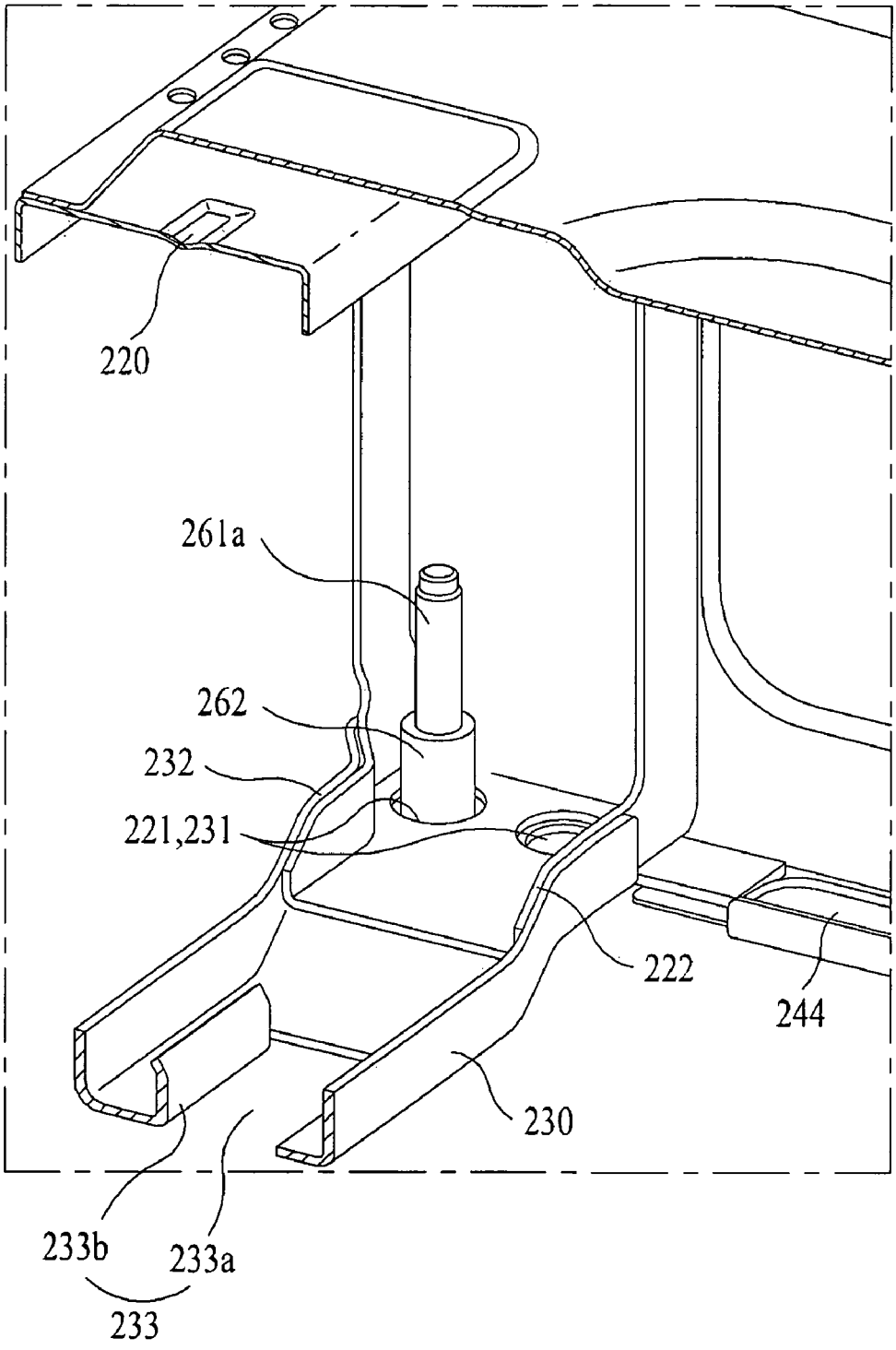
FIG. 6*b* is a perspective view partially illustrating a coupling portion between an upper frame and a lower frame.

If the drawer 250 shown in FIG. 2*a* is provided, the drawer 250 may replace members which close the bottom panel of the second cabinet 200, similar to the partition 300. As a result, the second cabinet 200 may have a minimum number of structural components capable of satisfying only the basic structural rigid and strength and this structure is shown in FIGS. 6*a* and 6*b* in detail. FIG. 6*a* is an exploded view illustrating the second cabinet of the washing machine and FIG. 6*b* is a perspective view partially illustrating a coupling portion between an upper frame and a lower frame of the second cabinet.

In reference to FIG. 6*a*, the second cabinet 200 includes a first frame 210*a* and a lower frame 210*b* which are spaced apart a predetermined distance from each other. Such the first and second frames 210*a* and 210*b* may be placed in both opposite ones out of front and rear portions or both side portions of the second cabinet 200. That is, the first and second frames 210*a* and 210*b* may be disposed in both opposite facing front and rear portions of the second cabinet 200 or both opposite facing side portions of the second cabinet 200.

As mentioned above, the partition 300 and the side panels of the first cabinet 100 may already provide the upper structure of the second cabinet 200 and the structural strength required by the upper structure of the second cabinet 200. Simultaneously with that, the partition 300 and the side panels of the first cabinet 100 may provide some part of the lower structure of the second cabinet 200 and the structural strength required by the partial side structure of the second cabinet 200. As a result, it is preferable that only the first and second frames 210*a* and 210*b* are installed in a front portion and a rear portion of the second cabinet 200 as a frame structure for an overall structural strength, instead of the both side panels.

Moreover, the first and second frames 210*a* and 210*b* have a rectangular frame shape. Because of this appearance, the first and second frames 210*a* and 210*b* may provide the front and rear portions of the second cabinet 200 with a basic structural rigid and strength. In addition, the first and second frames 210*a* and 210*b* may support the first cabinet 100, the partition 300 and the devices installed in the first cabinet 100 securely enough.

Beams composing upper, side and lower portions of the first and second frames 210*a* and 210*b* have the appropriate rigid and strength and they may form a basic structure of an upper, lower and side portion of the second cabinet 200. As mentioned above, the second cabinet 200 formed as one body with the first cabinet 100 can secure the structure for enough rigid and strength because of only the first and second frames 210*a* and 210*b*. As a result, any additional frames connecting the first and second frames 210*a* and 210*b* do not have to be provided between the first and second frames 210*a* and 210*b*. In stead of the additional frames, only a side panel 240 is coupled to side portions of the first and second frames 210*a* and 210*b*.

Since the first and second frames 210*a* and 210*b* have the rectangular frame shape as mentioned above, it is not preferable that the first and second frames 210*a* and 210*b* are not formed as a single member. However, it is preferable that the first and second frames 210*a* and 210*b* are formed as plural members from a manufacture assembly and production cost perspective. Accordingly, the first and second frames 210*a* and 210*b* are configured of an upper frame 220 and a lower frame 230 which are two members coupled to each other.

Such the upper and lower frames 220 and 230 may be fabricated in an angle shape. For example, the upper frame 220 may have a horizontal member forming an upper portion of the first and second frames 210*a* and 210*b* and a vertical member vertically extended from an end of the horizontal member to form a side portion of the first and second frames 210*a* and 210*b*. The lower frame 230 may have a horizontal member forming a lower portion of the first and second frames 210*a* and 210*b* and a vertical member vertically extended from an end of the horizontal member, which is opposite to the vertical member of the upper frame, to form another side portion of the first and second frames 210*a* and 210*b*, the end being opposite. If such the upper and lower frames 220 and 230 are coupled to each other, a rectangle frame shaped first and second frames are achieved.

On the other hand, the upper and lower frames 220 and 230 may have channel shapes with the same size. For example, the upper frame 220 includes a horizontal member forming an upper portion of the first and second frames 210*a* and 210*b* and vertical members extended downward from both ends of the horizontal member to a length corresponding to a half of the side length of the first and second frames 210*a* and 210*b*. The lower frame 230 includes a horizontal member forming a lower portion of the first and second frames 210*a* and 220*a* and vertical members extended upward from both ends of the horizontal member to the length identical to the length of the vertical member of the upper frame 220.

Although the upper and lower frames 220 and 230 may have various appearances, it is preferable that either of the upper and lower frames 220 and 230 has many members as possible to make its fabrication and assembly smooth and convenient. If then, either of the upper and lower frames 220 and 230 may the channel shape.

However, considering a position determination structure of the leg 260 which will be described later, the upper frame 220 may have the channel shape as shown in FIG. 6*a* and the lower frame 230 may have a simple bar shape.

Specifically, the upper frame 220 includes a horizontal member horizontally extended to form an upper portion of the first and second frames 210*a* and 210*b* and a vertical member vertically extended from both ends of the horizontal member to form a side portion of the first and second frames 210*a* and 210*b*. The horizontal member of the upper frame 220 covers a predetermined portion of the platform 310 of the partition as shown in FIG. 6*b* and this structure is similar to the structure of the cover 242 shown in FIG. 5*b*. The horizontal member of the upper frame 220 may cover an end of the securing member secured to the platform 310, like the cover 242 shown in FIG. 5*b*, such that the user may not be injured by the end of the securing member.

As shown in FIG. 6*a*, the upper frame 220 includes a upper flange 222 extended inward from its end, specifically, a lower end of the vertical member and such the upper flange 222 is substantially coupled to the lower frame 230. Clearly shown in FIG. 6*b*, the upper flange 222 is inserted in a lower flange 232 formed at an end portion of the lower frame 230. As a result, the lower frame 230 is attached to a lower end of the upper frame 220, that is, an outer surface, not an inner surface, of the upper flange 222 along a direction (C) shown in FIG. 6*a* as an arrow, such that the worker may assemble the upper frame 220 with the lower frame 230 smoothly and conveniently. Considering the structures described above, the first and second frames 210*a* and 210*b* enable the second cabinet 200 to have the proper structural rigid and strength by using the minimum law material and works.

In the meanwhile, to perform the assembly work conveniently, the first and second frames 210*a* and 210*b* may further include a position determination structure to place the upper and lower frames at accurate coupling positions, respectively.

The upper frame 220 includes a first position determination hole 221 formed at the upper flange 222 and the lower frame 230 includes a second position determination hole 231 formed at the lower flange 232, corresponding to the first position determination hole 221. In addition, a position determination pin 262 is installed at the first and second frames 210*a* and 210*b* and it passes via both of the first and second position determination holes 221 and 231.

Specifically, as mentioned above, the upper flange 222 of the upper frame 220 is inserted in the lower flange 232 of the lower frame 230 and after that the position determination pins 262 are inserted in both of the first and second position determination holes 221 and 231 formed at the upper flange 222 and the lower flange 232, respectively. Because of the insertion of the position determination pins 262, the first and second position determination holes 221 and 231 are aligned such that the upper flange 222 and the lower flange 232 are placed at their accurate coupling positions.

The inserted position determination pins 262 are also employed to primarily assemble the upper and lower frames 220 and 230 in order for the first and second frames 220 and 230 not to be separate from each other. As a result, the worker can assemble the upper and lower frames 220 and 230 securely and accurately because of the placing at the correct positions and primary assembling and accordingly work efficiency may be improved.

Moreover, the above position determination structure may share the position determination pins 262 with the leg 260 supporting the washing machine. That is, the position determination pins 262 may be some portion of the leg 260.

Specifically, as shown in FIG. 6*a*, the position determination pin 262 may be employed as a holder for coupling the leg 260 to the second cabinet 200. The leg 260 includes a body 261 having a rod 261*a* and the position determination pin, that is, the holder 262 is fastened to the rod 261*a* to couple the body 261 to the second cabinet 200.

For example, for the above fastening, the rod 261*a* includes a screw thread and the body 261 includes a corresponding screw thread fastened to the screw thread of the rod 261*a*. Because of the share of the part, the number of parts of the second cabinet 200 is substantially reduced and the coupling of the leg 260 and the coupling of the upper and lower frames 220 and 230 may be achieved. This structure of the second cabinet 200 can improve productivity noticeably.

The upper and lower flanges 222 and 232 include the pair of the first position determination holes 221 and the pair of the second position determination holes 231, respectively, as shown in FIGS. 6*a* and 6*b*. The pair of the first position determination holes 221 may be formed at the upper flange 222, specifically, a front and rear portion of the upper frame 220, respectively. The pair of the second position determination holes 231 may be formed at a front and rear portion of the lower flange 232, corresponding to the pair of the first position determination holes 221.

Such the pairs of the position determination holes 221 and 231 may have the above position determination structure, even if the upper and the lower flanges 222 and 232 are formed at either of the front and rear portion of the second cabinet 200. The versatility of the position determination structure enables both of the first and second frames 210*a* and 210*b* to be fabricated only with the upper and the lower flanges 222 and 232. As a result, the kinds of the parts may be reduced and the assembly lines may be simple.

In addition, the first and second frames 210*a* and 210*b* includes a grip 233 formed at lower portions of the frames, specifically, the lower frame 230.

The grip 233 includes an opening 233*a* formed at the lower frame 230. The worker pushes his/her finger into the opening 233*a* to lift the washing machine. For the worker to use the grip 233 more conveniently, a gripping structure may be formed at a rim of the opening 233*a*.

As shown in FIG. 6*b*, the gripping structure includes an extension 233*b* vertically extended from the rim of the opening 233*a*. If the extension 233*b* is formed at an inner rim of the opening 233*a*, the extension 233*b* may not be useable as the gripping structure. Thus, the extension 233*b* may be formed at an outer rim of the opening 233*a*.

Similar to the grip 233, a grip 244 is formed at a lower end of the side panel 240. Using the grips 233 and 244, the user may move the washing machine and the worker may move the second cabinet 200 or the united first and second cabinets 100 and 200 during the assembling work. Moreover, as shown in FIG. 4*c*, the securing member and tools may have access to the securing part via the grips 233 and 244 smoothly.

Therefore, the united first and second cabinets of the washing machine according the embodiment may provide the user with the additional functions and may substantially reduce the material and works required in manufacturing the washing machine. In addition, the second cabinet is configured of only the first and second frames, securing the appropriate structural rigid and strength with using the minimum material and assembly lines. As a result, when manufacturing washing machines, productivity may be improved and a released washing machine may have an improved exterior appearance.

Meanwhile, FIGS. 7-15 are drawings illustrating embodiments of washing machine having an auxiliary washing machine in the second space 200*a*.

Figure 7:
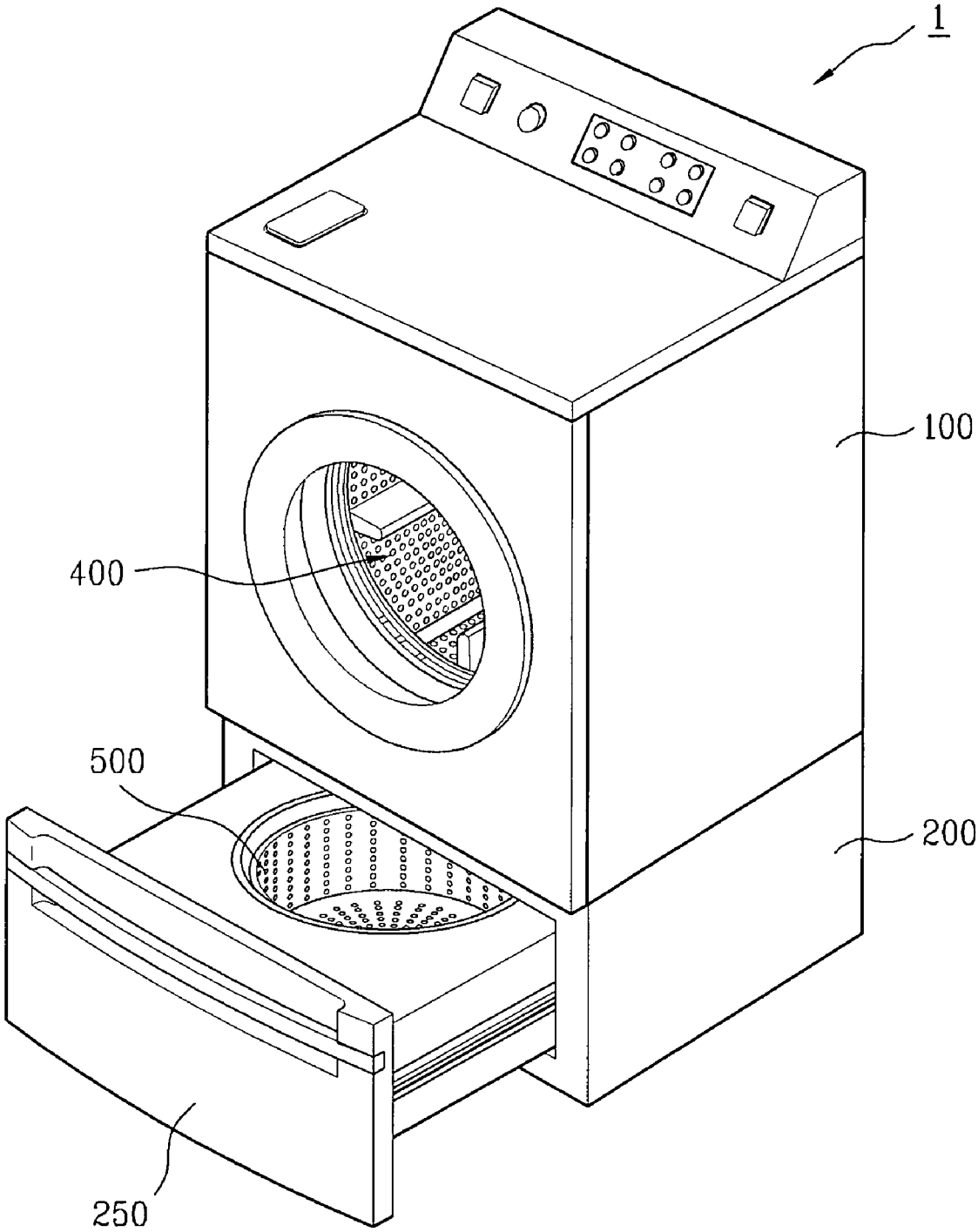
FIG. 7 is a perspective view of a washing machine having an auxiliary washing machine in accordance with one embodiment of the present invention.
Figure 8:
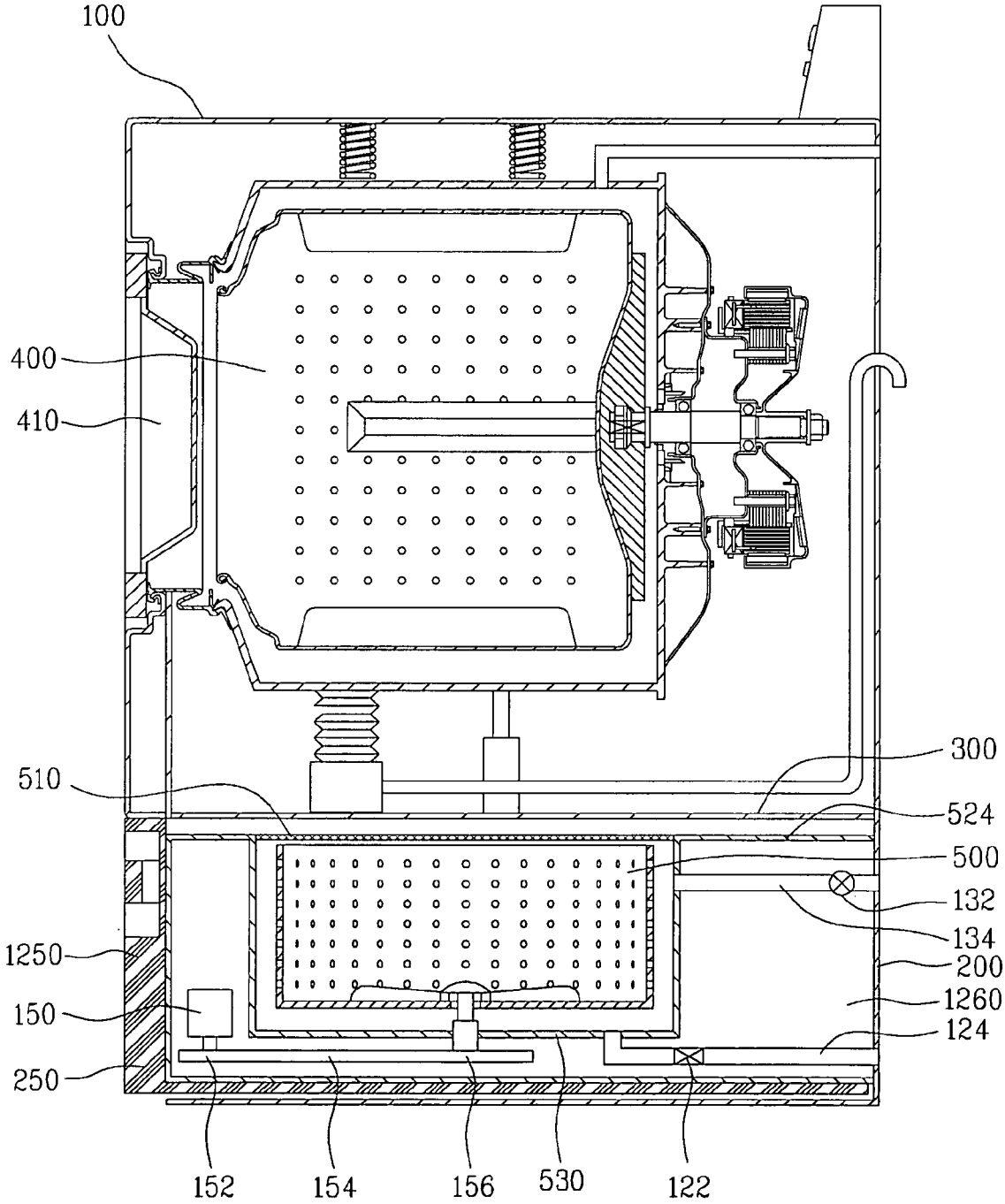
FIG. 8 is a sectional view of a washing machine of FIG. 7.

FIG. 7 illustrates a perspective view of a washing machine having an auxiliary washing machine in accordance with one embodiment of the present invention, and FIG. 8 illustrates a sectional view of a washing machine in accordance with an embodiment of the present invention.

The washing machine in accordance with an embodiment of the present invention will be described with reference to FIGS. 7 and 8.

Referring to FIGS. 7 and 8, the washing machine 1 includes a main drum 400 rotatably mounted in the first cabinet 100 for forming a space for holding large volume laundry, and a supplementary drum 500 rotatably mounted in the second cabinet 200 for forming a space for holding small volume laundry.

Accordingly, since both the large volume laundry and the small volume laundry can be treated with one washing machine without requiring a washing machine for treating the small volume laundry additionally, user's convenience can be improved. Moreover, in comparison to a case when both the large volume laundry and the small volume laundry are washed with separate washing machines respectively, the washing time period and the power consumption can be reduced.

The washing machine of the present invention will be described in more detail with reference to FIGS. 7 and 8. The supplementary drum 500 has a configuration for washing or drying the small volume laundry. The supplementary drum is rotated by a rotation shaft which is vertical to a bottom surface of the second cabinet 200, and has a plurality of pass through holes in a side wall for flow in/out of the washing water. The supplementary drum 500 has a water holding tub 530 on an outside of the supplementary drum 500 for holding the washing water, additionally.

The supplementary drum 500 may be positioned over or under the main drum 300. However, because frequency of washing the small volume laundry is lower than frequency of washing the large volume laundry, it is preferable that the supplementary drum 500 is positioned under the main drum 300.

In addition to this, the washing machine 100 includes a drawer 250 for housing the supplementary drum 500 and being drawable in a front direction of the second cabinet 200. The drawer 250 includes a front panel 1250 which forms a front exterior of the drawer, and a drum housing portion 1260 which is a space for housing the supplementary drum 500 therein.

The drawer 250 includes a frame 524 for covering the drawer 250, and it is preferable that the frame 524 and the water holding tub 530 are formed as one unit. A supplementary drum door 510 may be mounted to a top of the water holding tub 530 for introduction of the small volume laundry. Though not shown in the drawing, the supplementary drum door 510 may include a variety of locking device for locking the supplementary drum door 510. The supplementary drum door 510 can prevent the washing water from splashing to an outside of the supplementary drum 500.

In the meantime, referring to FIG. 8, the drawer 250 has a driving unit mounted therein for transmission of a driving power to the supplementary drum 500. The driving unit may be provided separate from the driving unit 350 which transmits a driving power to the main drum 300. For an example, the driving unit includes a motor 150 for transmission of rotating force to the supplementary drum 500, together with a driving pulley 152 connected to the rotation shaft of the motor 150, a follower pulley 156 connected to a rotation shaft of the supplementary drum 500, and a belt 154 which connects the driving pulley 152 to the follower pulley 156.

If the motor 150 rotates, the follower pulley 156 rotates through the driving pulley 152 and the belt 154, and if the supplementary drum 500 rotates accordingly, washing functions, such as washing, rinsing and spinning courses, can be performed. In the meantime, it is preferable that the motor 150 is reversible. In a case only the supplementary drum 500 is put into operation for washing the small volume laundry, the control unit (not shown) drives only the driving unit. According to this, power consumption required for the washing can be reduced.

Figure 9:
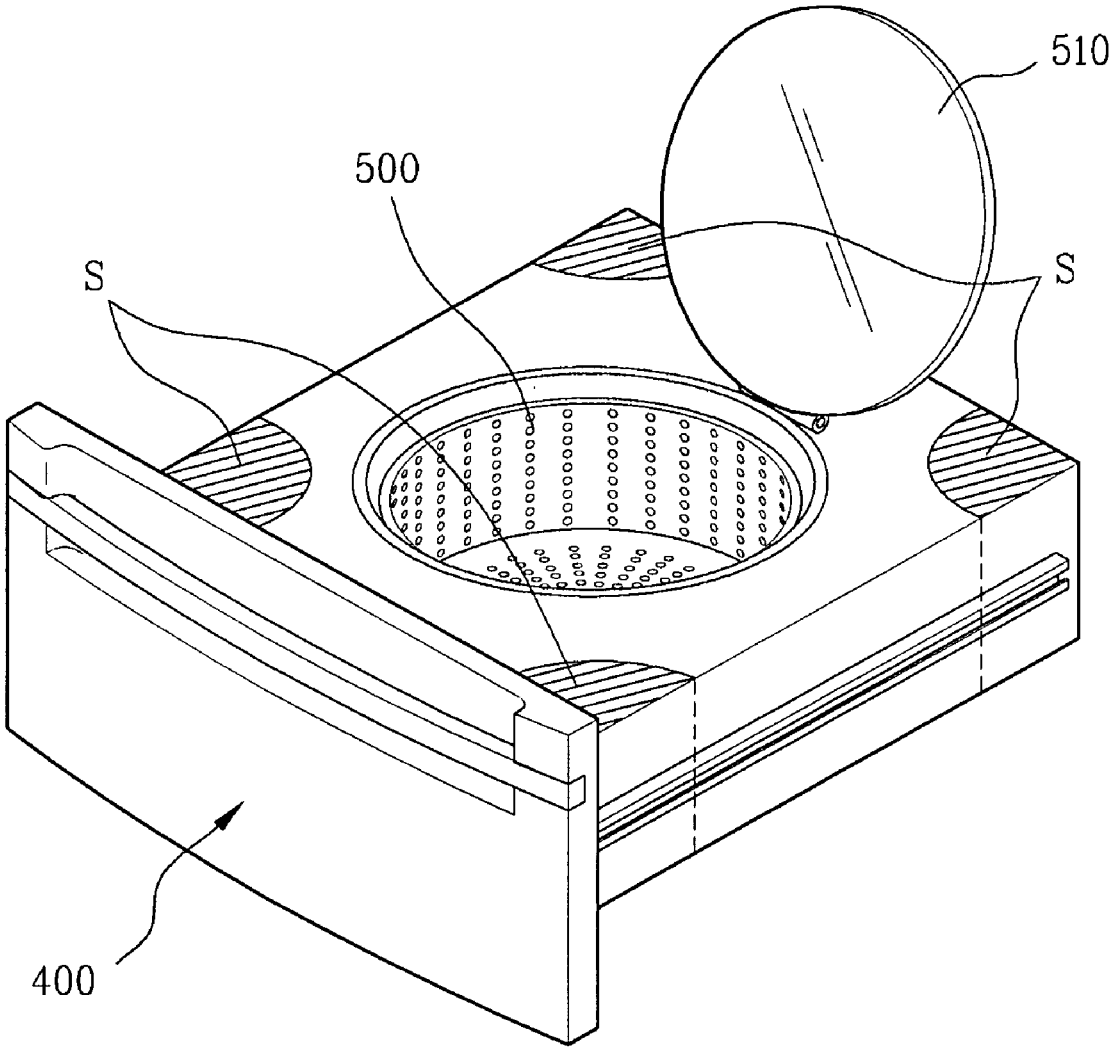
FIG. 9 is a perspective view of a drawer in a washing machine.

FIG. 9 illustrates a perspective view of a drawer in a washing machine in accordance with an embodiment of the present invention.

A position of the motor 150 will be described in detail with reference to FIG. 9. If the supplementary drum 500 is housed in the drawer 250, there can be spaces S formed at corners of the drawer 250. Therefore, the motor 150 can be mounted on a side of the supplementary drum 500. In other words, the motor 150 can be mounted in the space S formed between the water holding tub 530 and the drawer 250.

Though not shown, the motor 150 may be mounted to an outside surface of the water holding tub 530. In this case, the washing machine of the present invention can reduce a size of the drawer 250 in comparison to a case when the motor 150 is mounted under the supplementary drum 500.

Referring to FIG. 8, a water supply unit is mounted in the drawer 250 for supplying the washing water to the supplementary drum 500. The water supply unit may be provided separate from a water supply unit 330 which supplies the washing water to the main drum 300.

For an example, the water supply unit includes a water supply pipe 134 and a water supply valve 132 for supplying the washing water to an upper portion of the water holding tub 530. The water supply pipe 134 has one end connected to the upper portion of the water holding tub 530, and the other end fixed to an outside wall of the drawer 250. The water supply valve 132 may be mounted to the water supply pipe 134.

Particularly, it is preferable that the water supply pipe 134 is constructed of a material, or has a structure which is extendable in a drawing direction of the drawer, because it is required that the water supply pipe is extendable when the drawer 250 is drawn in a front direction of the cabinet 200.

In the meantime, referring to FIG. 8, a drain unit is mounted in the drawer 250 for draining the washing water from the supplementary drum 500 to an outside of the washing machine. The drain unit may be provided separate from a drain unit 320 which drains the washing water from the main drum 300 to an outside of the washing machine.

For an example, the drain unit may include a drain pipe 124 and a drain pump 122 for draining the washing water. The drain pipe 124 has one end connected to an underside of the water holding tub 530, and the other end fixed to an outside wall of the drawer 250. The drain pipe 124 has a drain pump 122 mounted thereto, and alike to the water supply pipe 134, it is preferable that the drain pipe 124 is constructed of a material, or has a structure which is extendable in a drawing direction of the drawer.

Figure 10:
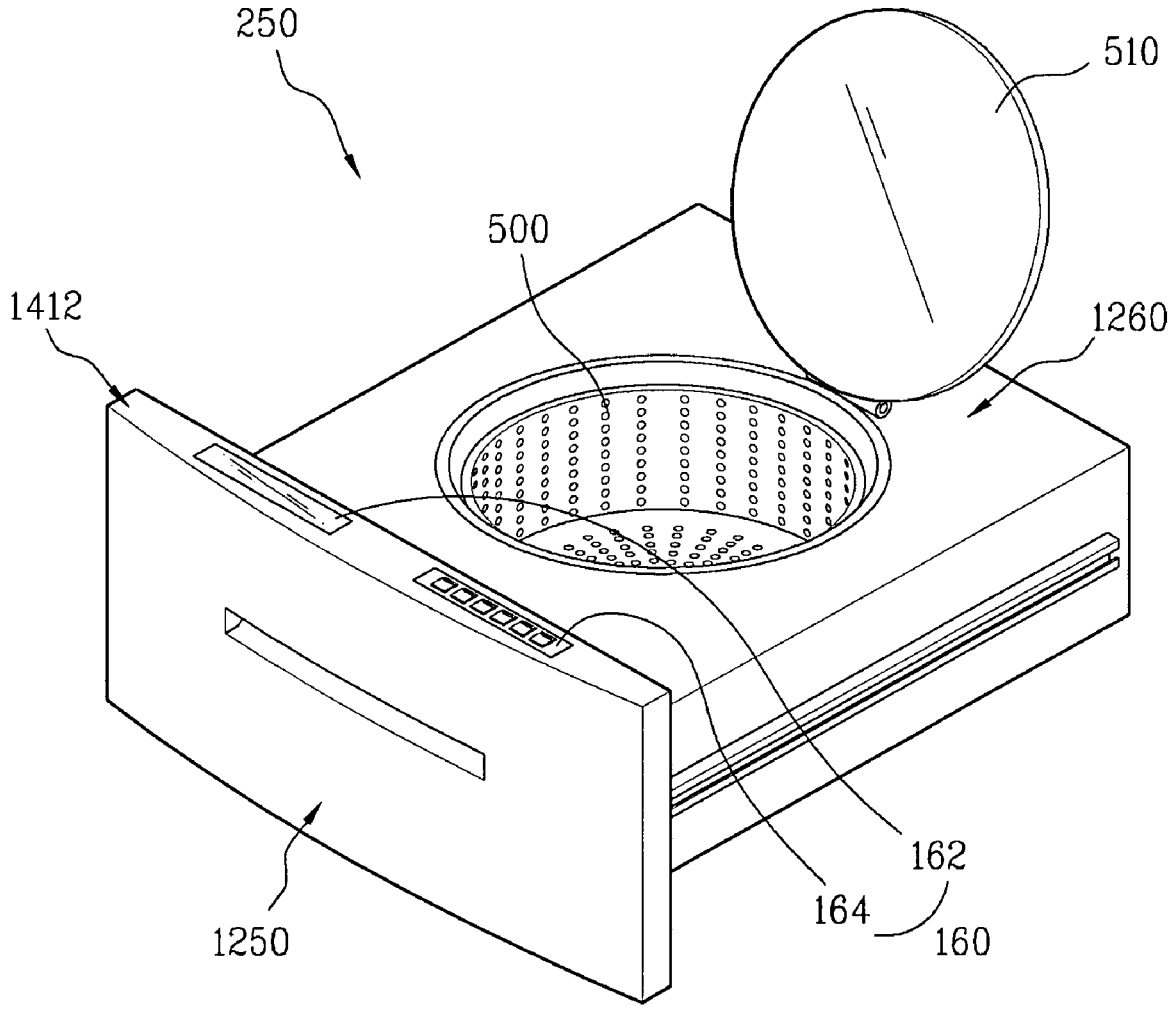
FIGS. 10, 11 and 12 are a plurality of embodiments of a drawer in a washing machine of the present invention.
Figure 11:
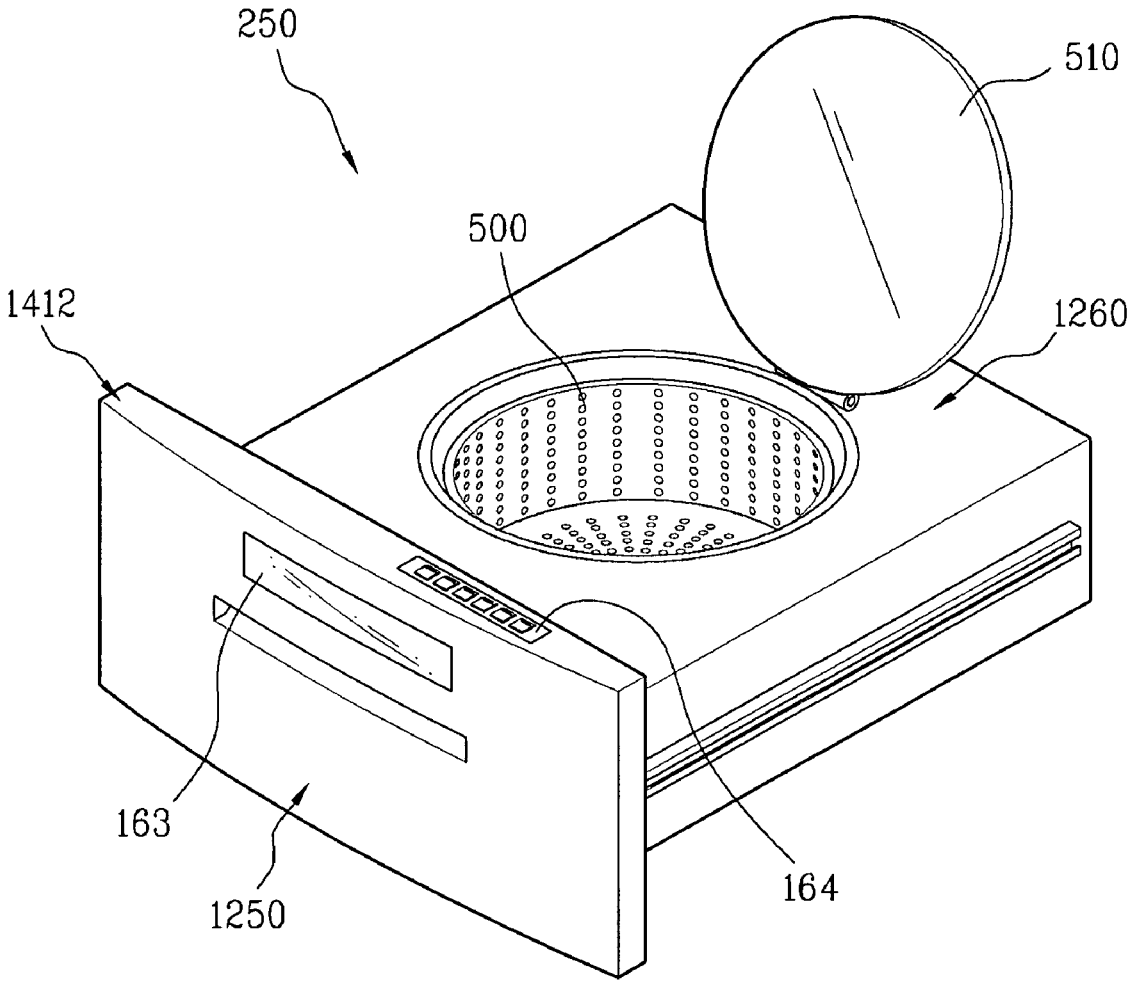
Figure 12:
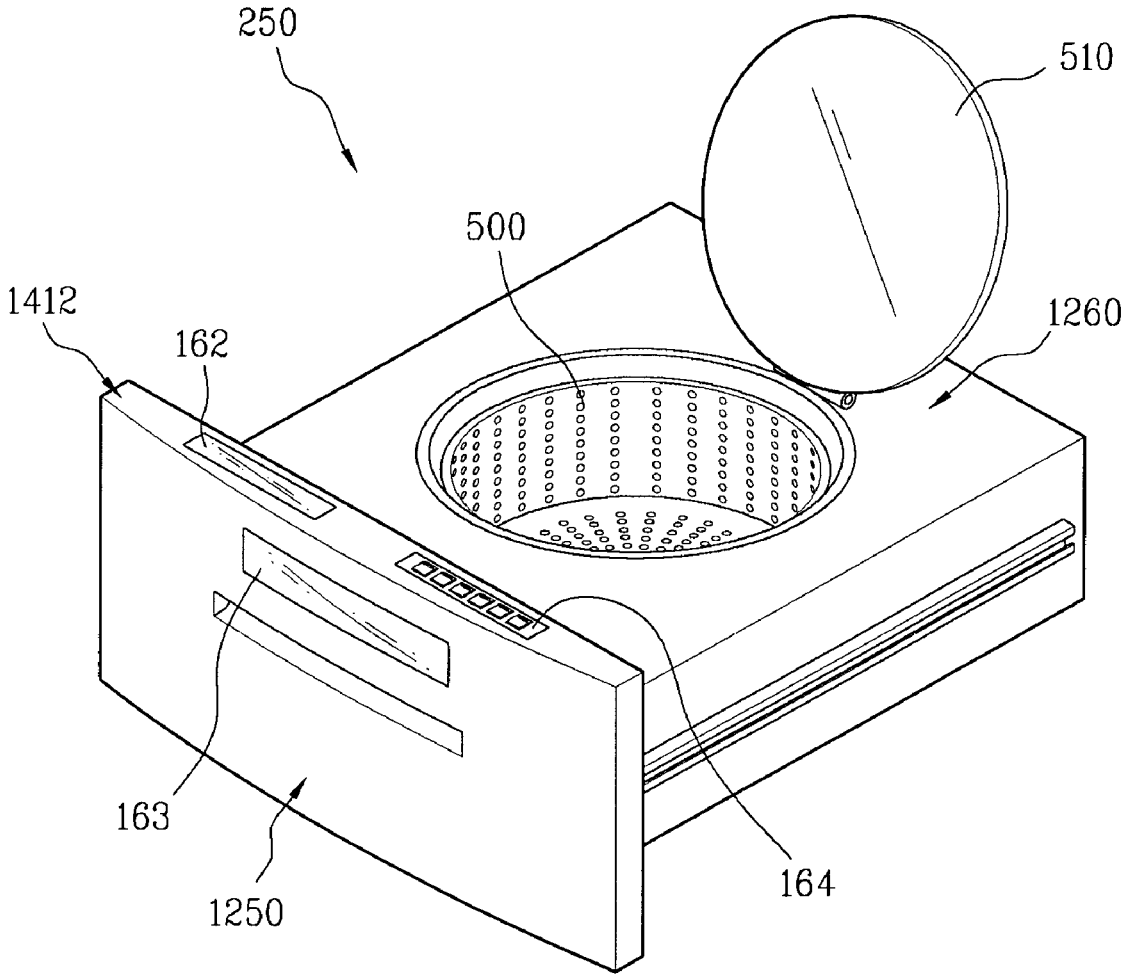

FIGS. 10, 11 and 12 illustrate a plurality of embodiments of a drawer in a washing machine of the present invention.

A first embodiment of drawer in a washing machine in accordance with the present invention will be described with reference to FIG. 10. The drawer 250 has an handling unit 160 on the front panel 1250 for handling driving of the supplementary drum 500.

The handling unit 160 includes an input unit 164 for user's inputting of functions of the supplementary drum 500 for operation of the supplementary drum 500. The handling unit 160 includes a display unit 162 and 163 for displaying an operation state of the supplementary drum 500 or an input state set by the input unit 164.

The input unit 164 enables the user to input a desired order or a washing course with a plurality of buttons. The input unit 164 may be mounted to a top surface 1412 or the front surface of the front panel 1250.

However, since the drawer 250 which houses the supplementary drum 500 has a structure drawable in a front direction of the second cabinet 200, it is preferable that the input unit 164 is mounted to the top surface 1412 of the front panel 1250 for making easy input in a state the drawer 250 is drawn.

FIG. 12 illustrates a perspective view of a third variation of a drawer in a washing machine of the present invention.

A display unit mounted to a drawer in the washing machine of the present invention will be described with reference to FIG. 12. The display unit may include a first display unit 162 for displaying an input state of the input unit 164 and an operation state of the supplementary drum 500, and a second display unit 163 for displaying only an operation state of the supplementary drum 500.

Positions of the first display unit 162 and the second display unit 163 will be described with reference to FIGS. 10, 11, and 12.

According to the drawer shown in FIG. 10, it is preferable that the first display unit 162 is mounted to the top surface 1412 of the front panel 1250. This is because the user can make easy notice of the input state of the input unit 164 and the operation state of the supplementary drum 400 without bending his (her) back forward.

In the meantime, according to the second variation of the drawer shown in FIG. 11, the second display unit 163 is mounted to the front surface of the front panel 1250.

This is because the second display unit 163 displays only the operation state of the supplementary drum 500 of a washing course or the like selected at the input unit 164.

That is, user's notice of the operation state of the supplementary drum 500 in a state the drawer 250 is pushed in the second cabinet 200 is preferable in view of convenience of the user.

Moreover, according to the third embodiment of the washing machine shown in FIG. 12, both the first display unit 162 and the second display unit 163 may be mounted to the front panel 1250 together. This is for enabling the user to notice the operation state of the supplementary drum 500 even in a state the drawer 250 is pulled out of the second cabinet 200 or pushed back into the second cabinet 200.

Meanwhile, the auxiliary washing machine may have a supply unit for supplying water to the supplementary drum separate from a supply unit for supplying water to the main drum.

Figure 13:
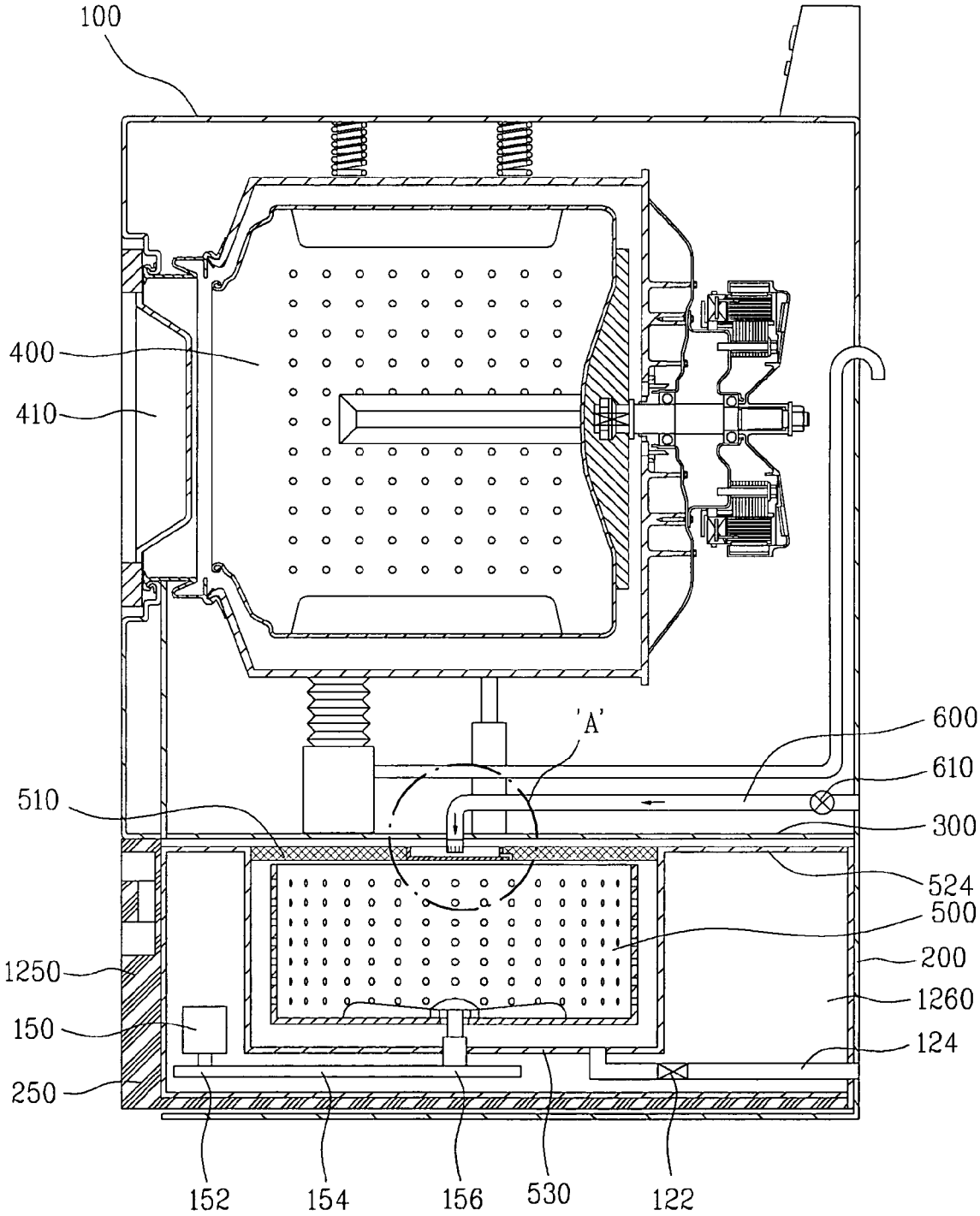
FIG. 13 is a sectional view of a washing machine in accordance with another embodiment of the present invention.
Figure 14:
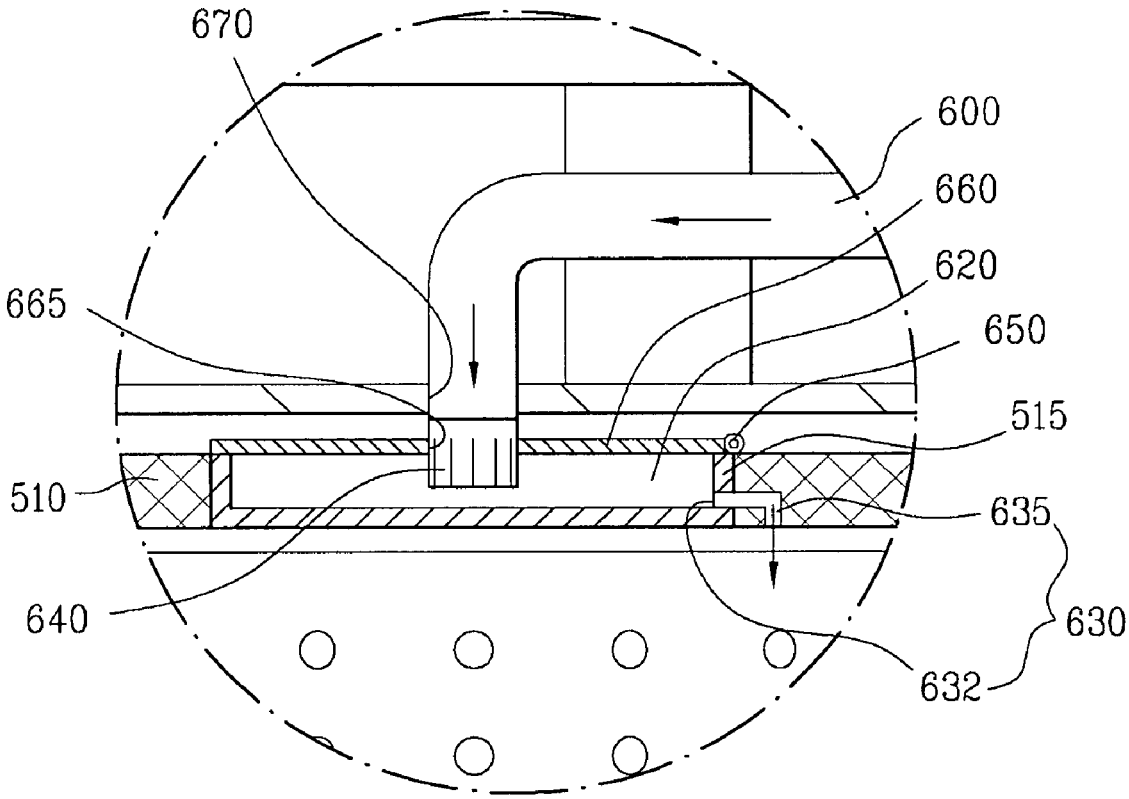
FIG. 14 is an enlarged view of the supply unit in FIG. 13.
Figure 15:
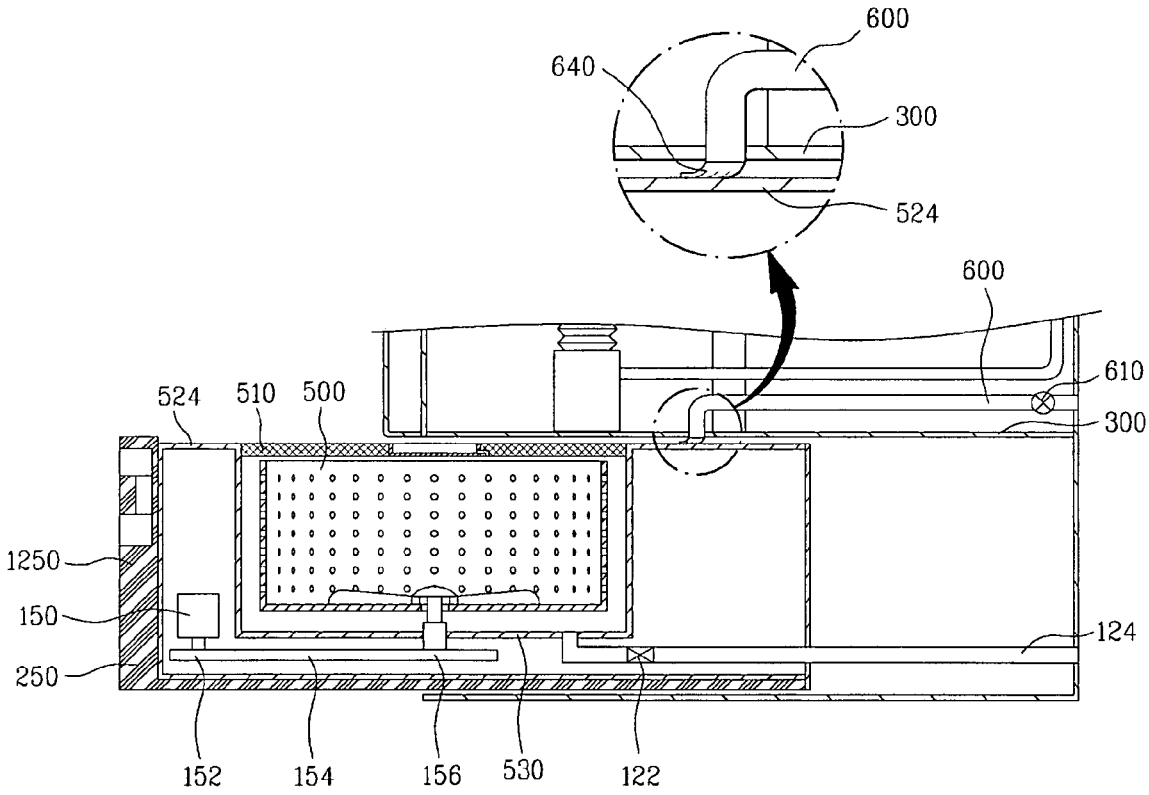
FIG. 15 is a sectional view of a washing machine with a drawer thereof in an open state

FIG. 13 illustrates a sectional view of a washing machine in accordance with another embodiment of the present invention, with a drawer thereof in a closed state. FIG. 14 illustrates an enlarged view of the supply unit in FIG. 13, and FIG. 15 illustrates a sectional view of a washing machine with a drawer thereof in an open state.

The supply unit will be described with reference to FIGS. 13, 14 and 15. The washing machine 1 of the present invention includes a supply unit over the supplementary drum 500 for supplying the washing water to the supplementary drum 500, additionally.

The supply unit includes a detergent box 620 for holding detergent, a water supply pipe 600 for supplying the washing water to the detergent box 620, and a discharge portion 630 for discharging the washing water from the detergent box 620 to the supplementary drum 500.

The detergent box 620 includes a space for holding detergent, and a detergent box door 660 openably secured by a rotation portion 650. The detergent box door 660 may have a recess (not shown) for user's easy opening of the detergent box door 660.

Therefore, if it is intended to introduce to the detergent to the detergent box 620, the user can introduce the detergent to the detergent box 620 only by opening the detergent box door 660 without removing the detergent box 620 from the supplementary drum door 510.

The detergent door box 660 also has a door pass through hole 665 for introduction of the washing water from the water supply pipe 600 to the detergent box 620.

The supplementary drum door 510 includes a detergent box opening 515 for placing the detergent box 620 therein.

This is for making the detergent box 620 to be removable from the supplementary drum door 510.

Accordingly, if it is required to clean the detergent box 620 of accumulated remained detergent, the user can remove the detergent box 620 from the supplementary drum door 510 for cleaning.

The water supply pipe 600, above the detergent box 620, supplies the washing water to the detergent box 620, and has a water supply valve 610 for controlling opening/closing of the water supply pipe 600, additionally.

The water supply pipe 600 is provided in the space of the first cabinet 100 divided by the partition 300.

In detail, the water supply pipe 600 has one end passed through a partition pass through hole 670, and the other end fixed to an outside wall of the first cabinet 100. In the meantime, the water supply valve 610 is mounted to the water supply pipe 600.

It is preferable that the water supply pipe 600 is provided such that the washing water is supplied from above the supplementary drum 500, and a form of the water supply pipe 600 bent at 90 degrees is one of an example of the provision.

Accordingly, if the drawer 250 is pushed back into the second cabinet 200, an end of the water supply pipe 600 from which the washing water is discharged is positioned over the detergent box 620. That is, if the drawer 250 is pushed back into the second cabinet 200 fully, the end of the water supply pipe 600 connected to the partition pass through hole 670 can be placed in the door pass through hole 665 in the detergent box door 660. Accordingly, the washing water can be discharged to the detergent box 620 through the water supply pipe 600.

However, it is liable that the washing water can leak to a periphery of the detergent box 620 when the washing water is introduced to the detergent box 620 through the water supply pipe 600, and the end of the water supply pipe 600 runs into the supplementary drum door 510 or the frame 524 to interfere with movement of the drawer 250 when the drawer 250 moves.

Therefore, in order to make movement of the drawer 250 smooth, and prevent the washing water from leaking, it is preferable that the end of the water supply pipe 600 has a leakage preventive portion 640.

The leakage preventive portion 640, mounted along an outside circumference of the water supply pipe 600 in an axis direction of the water supply pipe 600, may have a tube shape.

An end of the leakage preventive portion 640 interferes with the supplementary drum door 510 or the frame 524 when the drawer 250 is pushed back into the second cabinet 200 or pulled out of the second cabinet 200. However, if the drawer 250 is pushed back into the second cabinet 200 fully, the leakage preventive portion 640 is placed in the door pass through hole 665 in the detergent box door 660.

In the meantime, it is preferable that the leakage preventive portion 640 is formed of a soft material. Therefore, the leakage preventive portion 640 may be formed of rubber or plastic, and the end of the leakage preventive portion 640 may be cut at fixed intervals in the axis direction. According to this, when the drawer 250 is pushed back into the second cabinet 200 or pulled out of the second cabinet 200, the interference of the leakage preventive portion with the drawer 250 can be minimized.

Though not shown, the drawer 250 may include a supplementary water supply unit for supplying the washing water to the supplementary drum 500, additionally.

The discharge portion 630 includes a discharge hole 632 in one side of the detergent box 620 for discharging the washing water, and a discharge pipe 635 connected to the supplementary drum 500.

Therefore, according to the washing machine described above, the unitedly assembled first and second cabinets can provide the user with the additional functions and can substantially reduce the material and works required in the manufacturing process of the washing machine. As a result, the productivity of the washing machine may be improved and the completely assembled washing machine may have an enhanced exterior appearance.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine comprising:

a tub holding wash water;

a drum rotatable within the tub to hold laundry;

a first cabinet forming a first space provided with the tub and the drum to wash laundry;

a second cabinet forming a second space for additional function, the second cabinet formed as one body with the first cabinet;

a single partition wall provided between the first and second cabinets to partition off the second space from the first space, wherein the second cabinet comprises a first frame and a second frame provided in both opposite portions out of front and rear portions and side portions of the second cabinet, the first and second frames having a rectangular shape, wherein the single partition wall covers the bottom of the first cabinet, simultaneously covering the top of the second cabinet, and the first and second frames are configured of an upper frame and a lower frame coupled to the upper frame and the upper frame covers ends of securing member secured to the single partition wall, wherein the single partition wall is supported by the upper frame of the first frame and the upper frame of the second frame and the tub and the drum are mounted on the single partition wall.

2. The washing machine of claim 1, wherein the first and second frames are provided in a front and rear portion of the second cabinet, respectively.

3. The washing machine of claim 2, wherein the second cabinet further comprises a side panel coupled to side portions of the first and second frames.

4. The washing machine of claim 3, wherein the side panel comprises a grip formed at a lower end thereof.

5. The washing machine of claim 1, wherein the upper and lower frames have an angle shape.

6. The washing machine of claim 1, wherein the upper and lower frames have a channel shape with the same size.

7. The washing machine of claim 1, wherein either of the upper and lower frames has a bar shape and the other has a channel shape.

8. The washing machine of claim 7, wherein if the upper frame has a channel shape and the lower frame has a bar shape, the upper frame has a flange extended inward from a lower end thereof, the flange being coupled to the lower frame.

9. The washing machine of claim 8, wherein the flange is inserted in the lower frame.

10. The washing machine of claim 1, wherein the first and second frames further comprising, a position determination part provided at a coupling portion between the upper frame and the lower frame, the position determination part positioning the upper frame and lower frame to be coupled accurately.

11. The washing machine of claim 10, wherein the position determination part comprising:

a first position determination hole formed at the upper frame;

a second position determination hole formed at the lower frame; and a position determination pin passing through the first and second position determination holes to align the first and second position determination holes.

12. The washing machine of claim 11, wherein the upper frame comprises a pair of first position determination holes formed at a front and rear portion thereof, respectively, and the lower frame comprises a pair of second position determination holes formed at a front and rear portion thereof, respectively, corresponding to the pair of the first position determination holes.

13. The washing machine of claim 11, wherein the position determination pin is configured of a holder coupling the leg to the second cabinet.

14. The washing machine of claim 1, wherein the first and second frames comprise a grip for a user or worker to move the washing machine.

15. The washing machine of claim 14, wherein the grip comprises an opening formed at lower portions of the first and second frames for the user's or worker's finger to insert in.

16. The washing machine of claim 15, wherein the grip comprises a gripping structure formed at a rim of the opening.

17. The washing machine of claim 16, wherein the gripping structure comprises an extension vertically extended from the rip of the opening.

18. The washing machine of claim 16, wherein the gripping structure is formed at an outer rim of the opening.

* * * * *